US010091844B2

(12) United States Patent
Hu et al.

(10) Patent No.: US 10,091,844 B2
(45) Date of Patent: Oct. 2, 2018

(54) POWER SUPPLY FOR LED LAMP WITH TRIAC DIMMER

(71) Applicants: SHANGHAI SIM-BCD SEMICONDUCTOR MANUFACTURING CO., LTD., Shanghai (CN); BCD SEMICONDUCTOR MANUFACTURING LIMITED, George Town, Grand Cayman (KY)

(72) Inventors: Zhimin Hu, Shanghai (CN); Xuegang Ren, Shanghai (CN)

(73) Assignee: BCD Semiconductor Manufacturing Limited, George Town, Grand Cayman (KY)

( * ) Notice: Subject to any disclaimer, the term of this patent is extended or adjusted under 35 U.S.C. 154(b) by 0 days.

(21) Appl. No.: 14/936,481

(22) Filed: Nov. 9, 2015

(65) Prior Publication Data

US 2017/0027029 A1 Jan. 26, 2017

Related U.S. Application Data

(63) Continuation of application No. PCT/CN2013/075496, filed on May 10, 2013.

(51) Int. Cl.
*H05B 33/08* (2006.01)

(52) U.S. Cl.
CPC ..... *H05B 33/0815* (2013.01); *H05B 33/0845* (2013.01); *H05B 33/0848* (2013.01)

(58) Field of Classification Search
CPC ..... H05B 33/0815; H05B 33/0845; H05B 33/0809; H05B 33/0851; H05B 33/0818;
(Continued)

(56) References Cited

U.S. PATENT DOCUMENTS 8,581,498 B1 * 11/2013 Cheung ..... H05B 33/0815 315/119
8,884,537 B2 * 11/2014 Liao ..... G05F 1/10 315/179

(Continued)

FOREIGN PATENT DOCUMENTS

CN 101951177 A 1/2011
CN 102062376 A 5/2011

(Continued)

OTHER PUBLICATIONS

Notification of Transmittal of the International Search Report and the Written Opinion of PCT Application No. PCT/CN2013/075496, dated Feb. 27, 2014, 13 pages total.

*Primary Examiner* — Tung X Le
*Assistant Examiner* — Borna Alaeddini

(57) ABSTRACT

A bleeder circuit is provided in a switched mode power supply (SMPS) that provides a compensation current when the loop current drops below the holding current of the TRIAC to alleviate light flickering problem. Further, automatic power factor correction is also provided in embodiments of the invention, which enables the output current to be in phase with the input voltage. The power factor correction not only improves the efficiency of the power supply, it can also reduce the compensation current and the duration in which compensation current flows, thereby reducing the power loss in the bleeder circuit.

17 Claims, 19 Drawing Sheets

(58) Field of Classification Search
CPC ..... H05B 33/0848; H05B 33/08; H05B 33/0824; H05B 33/089; H05B 33/0827; H05B 33/083; H05B 33/0887; H05B 37/02; H05B 37/0272; H05B 37/029; H05B 39/044; H05B 41/2855; H05B 41/2985; H05B 33/0806
See application file for complete search history.

(56) References Cited

U.S. PATENT DOCUMENTS 8,922,135 B2 * 12/2014 Sumitani ..... H05B 33/0815 315/201
2011/0140622 A1 6/2011 Suzuki
2012/0056551 A1 * 3/2012 Zhu ..... H02M 1/4258 315/232
2012/0056553 A1 * 3/2012 Koolen ..... H05B 33/0815 315/291
2012/0242252 A1 * 9/2012 Yang ..... H05B 33/0815 315/307
2012/0299572 A1 * 11/2012 Eom ..... H05B 33/0815 323/312
2012/0326616 A1 * 12/2012 Sumitani ..... H05B 33/0815 315/201
2013/0278159 A1 * 10/2013 Del Carmen, Jr. ..... H05B 33/0809 315/200 R
2015/0069929 A1 * 3/2015 Sumitani ..... H05B 33/0815 315/291
2015/0137704 A1 * 5/2015 Angeles ..... H05B 33/0815 315/297
2015/0237695 A1 * 8/2015 Jelaca ..... H05B 33/0815 315/291

FOREIGN PATENT DOCUMENTS

CN 102291899 A 12/2011
CN 202652643 U 1/2013

* cited by examiner

POWER SUPPLY FOR LED LAMP WITH TRIAC DIMMER

CROSS-REFERENCES TO RELATED APPLICATIONS

This application claims priority to and is a continuation of International Application PCT/CN2013/075496, with an international filing date of May 10, 2013, the content of which is incorporated herein by reference in its entirety. This application is also related to U.S. application Ser. No. 13/050,236, filed Mar. 17, 2011, which is commonly owned and incorporated by reference herein in its entirety.

BACKGROUND OF THE INVENTION

The present invention relates to the area of LED lightling technology, and in particular relates to methods and an apparatus for power supply for driving an LED light system with a TRIAC (Triode for Alternating Current) dimmer.

LED (light-emitting diode) lighting systems as a fourth-generation light source have gradually replaced conventional fluorescent and incandescent lighting in a wide range of applications in various fields. In comparison with conventional lighting technologies, LED lamps have many advantages, for example, high light efficiency, long life, low power consumption, and so on. However, there are still challenges in using LED lamps to replace conventional light source. For example, conventional light systems often include TRIAC dimmers for adjusting brightness of light output. When an LED lamp is used to replace the fluorescent or incandescent lamp, the LED lamp often suffers from flickers. It can also be difficult to achieve a wide range of dimming control.

As is known in the art, a TRIAC is a bidirectional semiconductor switching device that allows large current to flow through in either direction when triggered by a positive or negative current at its gate electrode. Once triggered, the device continues to conduct until the current drops below a certain threshold, called the holding current.

Thus, for a TRIAC switch to work properly, it needs a trigger current $I_L$ and a holding current $I_{holding}$. The trigger current is a minimum current of the trigger signal at the gate to cause a current to flow in the TRIAC, and the holding current is the minimum current to maintain conduction after the TRIAC is triggered. Once the current flowing through the TRIAC is not sufficient maintain the holding current, the TRIAC will turn off and may cause TRIAC to be triggered again. As a result, light flickering often occurs.

Therefore, there is a need for improved power supply for driving an LED light source and maintain compatibility with conventional TRIAC dimmers.

BRIEF SUMMARY OF THE INVENTION

The inventors of this invention have discovered that the LED lamp inherently consumes less current than conventional lamps and may not provide enough current to sustain the holding current for the TRIAC dimmer designed for a conventional lighting system. As a result, light flickers may occur when an LED lamp is used to directly replace conventional incandescent or halogen lamps with a TRIAC dimmer. Further, the problem can be made worse because the TRIAC conduction angle is smaller, causing the input current to be even smaller. Moreover, the performance characteristics of TRIAC dimmers from different manufacturers can vary, making it difficult for an LED driver to maintain compatibility with conventional lighting systems that includes TRIAC dimmers.

According to embodiments of the present invention, a bleeder circuit is provided in a switched mode power supply (SMPS) that provides a compensation current when the loop current drops below the holding current of the TRIAC to alleviate light flickering problem. Further, automatic power factor correction is also provided in embodiments of the invention, which enables the output current to be in phase with the input voltage. The power factor correction not only improves the efficiency of the power supply, it can also reduce the compensation current and the duration in which compensation current flows, thereby reducing the power loss in the bleeder circuit.

According to embodiments of the present invention, a power supply is provided for an LED (light-emitting diode) lighting system with a TRIAC (Triode for Alternating Current) dimmer. The power supply includes a rectifier circuit for coupling to an AC input voltage through a TRIAC dimmer. The TRIAC dimmer is characterized by a holding current, and the rectifier circuit having a first output terminal and a second output terminal. A transformer is coupled to the first output terminal of the rectifier circuit for receiving a rectified DC input voltage. The transformer has a primary winding and a secondary winding. A power switch is coupled to the primary winding of the transformer. The power supply also has a controller coupled to the power switch for controlling a current flow in the primary winding to provide a controlled output to an LED load. The controller is configured to control current pulses in the primary winding such that an envelope waveform formed by peak points of the current pulses is in phase with the AC input voltage, thereby improving the power factor of the power supply. Moreover, the power supply also has a bleeder circuit coupled to the rectifier circuit, which is configured to maintain a current flow through the rectifier circuit that is equal to or greater than the holding current of the TRIAC.

According to some embodiments of the invention, a control circuit is provided for an LED (light-emitting diode) lighting system that includes a rectifier circuit for coupling to an AC input voltage through a TRIAC (Triode for Alternating Current) dimmer. The TRIAC dimmer is characterized by a holding current, and the rectifier circuit is configured to provide a rectified DC input voltage to an inductor for supplying power to an LED load. The control circuit includes a controller for coupling to a power switch for controlling a current flow in the inductor. The controller is configured to control current pulses in the inductor such that an envelope waveform formed by peak points of the current pulses is in phase with the AC input voltage. The control circuit further includes a bleeder circuit coupled to the rectifier circuit, which is configured to maintain a current flow through the rectifier circuit at a magnitude of at least the holding current of the TRIAC. In some embodiments, the controller and the bleeder circuit are included in a single integrated circuit (IC).

According to some embodiments, a bleeder circuit is provided for maintaining a minimum current flow between first and second terminals of a circuit loop. The bleeder circuit includes a first resistor and a bipolar transistor connected in series between the first terminal and an internal node of the circuit loop. A base of the bipolar transistor is coupled to a bias voltage. A second resistor is coupled between the second terminal of the circuit loop and the internal node. Further, a first diode and a second diode are connected in series between the second terminal of the circuit loop and the base of the bipolar transistor. The resistance of the second resistor, R, is selected such that $$R = \frac{V_{d1} + V_{d2} - V_{BE}}{I_{min}}$$

wherein:

$V_{d1}$ is the forward voltage drop of the first diode, $V_{d2}$ is the forward voltage drop of the second diode, $V_{BE}$ is the forward base-emitter voltage of the bipolar transistor, and $I_{min}$ is the minimum current.

In alternative embodiments, a method is provided for reducing bleeder current consumption in a switched mode power supply (SMPS) for an LED (light-emitting diode) lighting system that includes a rectifier circuit for coupling to an AC input voltage through a TRIAC (Triode for Alternating Current) dimmer. The TRIAC dimmer is characterized by a holding current, and the rectifier circuit having a first output terminal and a second output terminal. The rectifier circuit is configured to provide a rectified DC input voltage to an inductor for supplying power to an LED load. The method includes providing a controller for coupling to a power switch for controlling a current flow in the inductor, the controller being configured to provide controlled output current to the LED load according to the rectified DC input voltage. The method also provides a bleeder circuit coupled to the rectifier circuit, wherein the bleeder circuit is configured to provide a compensation current when the current flow through the rectifier circuit falls below the holding current of the TRIAC. Moreover, the method also includes configuring the controller to control current pulses in the inductor such that an envelope waveform formed by peak points of the current pulses is in phase with the AC input voltage, which enables the output current to be in phase with the input voltage. This improves the power factor of the system and reduce current consumption caused by the compensation current in the bleeder circuit.

A further understanding of the nature and advantages of the present invention may be realized by reference to the remaining portions of the specification and the drawings.

DETAILED DESCRIPTION OF THE INVENTION

According to embodiments of the present invention, a power supply is provided for an LED (light-emitting diode) lighting system with a TRIAC (Triode for Alternating Current) dimmer. The power supply includes a controller coupled to a power switch for controlling a current flow in a transformer to provide a controlled output current to an LED load. The controller is configured to cause the output current to be in phase with the input AC voltage, thereby improving the power factor of the power supply. Moreover, the power supply also has a bleeder circuit coupled to the rectifier circuit, which is configured to maintain a current flow through the rectifier circuit that is equal to or greater than the holding current of the TRIAC. Further, it is shown that the power factor correction feature also reduces the power consumption of the bleeder circuit.

Figure 1:
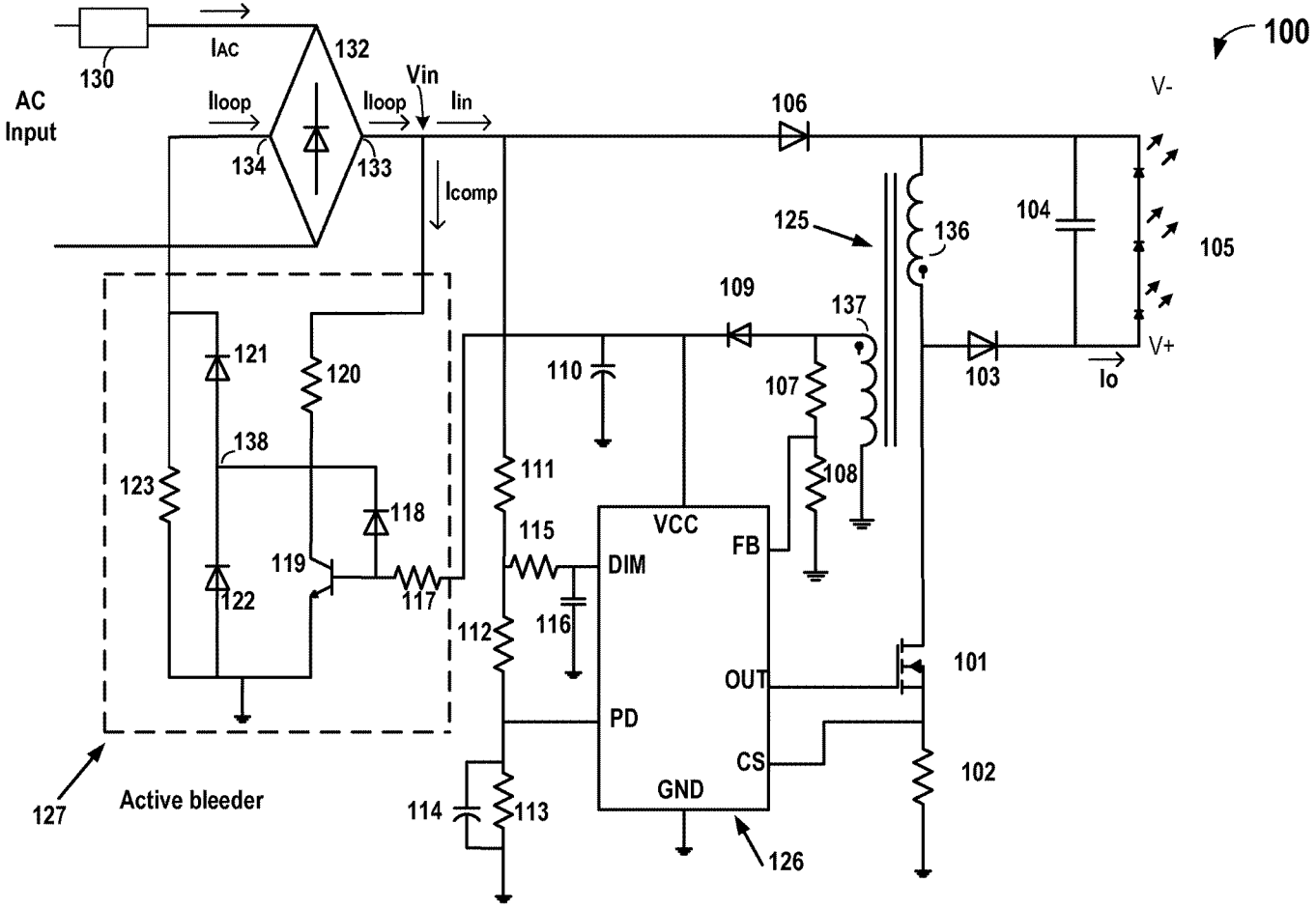
FIG. 1 is a simplfied schematic diagram illustrating an LED lighting system including a TRIAC dimmer according to an embodiment of the present invention.

FIG. 1 is a simplfied schematic diagram illustrating an LED lighting system including a TRIAC dimmer according to an embodiment of the present invention. As shown in FIG. 1, LED lighting system 100 includes a rectifying circuit 132, which has a first terminal 133 and a second terminal 134, connected to an AC input power source through a TRIAC dimmer 130. A switch mode power supply includes a transformer 125 coupled to rectifying circuit 132 to provide power to an LED lamp load 105.

As shown in FIG. 1, transformer 125 includes a primary winding 136 and a secondary winding 137. Transformer 125 is connected to a power switch 101, which is controlled by a controller 126. When power switch 101 is turned on, input current flows through a diode 106 store energy in the primary winding. When power switch 101 is turned off, the energy stored in the primary winding is transferred to LED lamp 105 through a fast recovery diode 103 and a filter capacitor 104. Secondary winding 137 provides operating power to controller 126 at terminal VCC via a rectifying diode 109. Secondary winding 137 also provide a feedback voltage FB through a voltage divider circuit consisting of resistors 107 and 108. Feedback voltage FB is used by controller 126 to control the power supply. One of the parameters determined by controller 126 is the diode 103 conduction time signal Tons.

In FIG. 1, controller 126 also receives a current sense signal CS that reflects a peak current of the primary winding through a current sense resistor 102, which is connected to power switch 101. Controller 126 also provides a control signal OUT to control the on and off of power switch 101. Further, contrroller 126 monitors the voltage from rectifier circuit 132 through resistors 111, 112, and 113. Resistor 113 is coupled in parallel to a capacitor 114. Controller 126 also has a terminal DIM for monitoring the average amplitude of the current from rectifier circuit 132 through resistors 111 and 115, and a capacitor 116. In embodiments of the invention, controller 126 is configured to use the above-mentioned signals to provide a constant current output to LED lamp 105 with dimmer control.

In an embodiment as shown in FIG. 1, controller 126 includes the following terminals:

- a first input terminal (VCC) for receiving operating power from the secondary winding,
- a second input terminal (DIM) for sensing an average current from the rectifier circuit to determine a magnitude of the controlled output to the LED load,
- a third input terminal (PD) for sensing the rectified DC input voltage for controlling the current pulses in the primary winding, and
- an output terminal (OUT) for controlling the on and off of the power switch.

Under control of controller 126, the power supply in FIG. 1 provides a constant output current Io according to the following relationships.

$$I_{pk} = \frac{V_{cs}}{R_{cs}}$$

$$I_o = \frac{T_{ons}}{2 * T_{sw}} * I_{pk} = \frac{T_{ons} * V_{cs}}{2 * T_{sw} * R_{cs}}$$

where $I_{pk}$ is the peak primary winding current, $V_{cs}$ is a reference voltage, $R_{cs}$ is a peak current sense resistor, $T_{ons}$ is the conduction time of the diode, and $T_{sw}$ is the period of the PFM (pulse frequency modulation) control signal.

In some embodiments, the dimmer function is realized by changing the average magnitude of the input voltage with the dimmer angle of the dimmer circuit. The controller varies the brightness of the LED lamp by the turn-on and turn-off of the power switch to control $T_{ons}$, which is the conduction time of the fast-recovery diode 103.

The input current at the output of the rectifier bridge $I_{in}$ is determined as described below.

Let the input voltage be $V_{in}=\sqrt{2}V_{in_rms}*\sin\theta$ $$I_{in} = \frac{I_{pk} * T_{onp}}{2 * T_{sw}}$$

-continued $$T_{onp} = \frac{L * I_{pk}}{V_{in}}$$

$$I_{in} = \frac{\frac{V_{cs}}{R_{cs}} * \frac{L * I_{pk}}{V_{in}}}{2 * \frac{T_{ons}}{K}} = \frac{L * K * V_{cs}^2}{2 * R_{cs}^2 * T_{ons} * V_{in}} = \frac{V_{out} * K * V_{cs}}{2 * R_{cs} * \sqrt{2}\, V_{in_rms} * \sin\theta}$$

$$V_{cs} = \frac{V_{pd}}{V_{dim}} * V_{CS_REF} = K_{LINE} * V_{CS_REF} * \sin\theta$$

$$I_{in} = \frac{V_{out} * K * V_{cs}}{2 * R_{cs} * \sqrt{2}\, V_{in_rms} * \sin\theta} = \frac{V_{out} * V_{CS_REF} * K_c * K_{LINE}^2}{2\sqrt{2} * R_{cs} * V_{in_rms}} * \sin\theta$$

where $T_{onp}$ is the conduction time of the power switch in a period, L is a primary side inductor, $V_{pd}$ is the sampled instantaneous value of the rectified input voltage, $V_{dim}$ is the sampled average rectified input voltage, and $K_c$, $V_{CS_REF}$, $V_{CS_REF}$ and $K_{LINE}$ are parameters used by the controller. It can be seen that the input current $I_{in}$ has the same phase angle as the input voltage Vcs. Thus, the power factor correction (PFC) function is realized. In some embodiments, the controller is configured to control current pulses in the primary winding such that an envelope waveform formed by peak points of the current pulses is in phase with the AC input voltage thereby improving the power factor of the power supply. Further details of the power factor correction (PFC) function are described below in connection with FIGS. 4A-14.

As also shown in FIG. 1, embodiments of the present invention provides a bleeder circuit 127 to overcome these difficulties in maintaining the TRIAC holding current to solve the problem of light flicker in an LED lighting system with a TRIAC dimmer As shown in FIG. 1, bleeder circuit 127 is connected to the outputs of bridge rectifier 132 to provide a compensation current $I_{comp}$ when the output current $I_{loop}$ of the rectifier 132 drops below a preset limit that causes the current through the TRIAC, $I_{AC}$, to fall below the TRIAC holding current $I_{holding}$. As shown in FIG. 1, bleeder circuit 127 includes a resistor 120 connected to an output positive terminal 133 of rectifier bridge 132 and the collector of an NPN transistor 119. A bias voltage is provided by VCC and is connected through resistor 117 to the base electrode of transistor 119, whose emitter is connected to ground. The negative terminal 134 of rectifier bridge 132 is connected to a resistor 123 and serially connected diodes 121 and 122. A node 138 between diodes 121 and 122 is connected to the base of transistor 119 through a diode 118. Assuming the forward voltage drop of the diodes is 0.7 V, then the voltage drop across diodes 121 and 118 is equal to 1.4 V. Let Vbe be the forward base-emitter voltage of transistor 119 and VR123 be the voltage across resistor 123, then $$VR123+Vbe=1.4\ V.$$

In other words, the sum of the voltage drop across resistor 123 and Vbe and is clamped at the sum of the base-emitter voltages of diodes 121 and 118, e.g., about 1.4 V.

In normal operation, transistor 119 is off, and rectifier output current $I_{loop}$ flows through resistor 123 and, if the voltage across resistor 123 is sufficient to maintain the forward diode voltage drop, the serially connected diodes 121 and 122. When the rectifier output current $I_{loop}$ decreases, then the voltage drop across resistor 123 is reduced. When the voltage across resistor 123 is below 0.7 V, it causes Vbe to become greater than about 0.7 V, and transistor 119 is turned on. As a result, a compensation current $I_{comp}$ starts to flow through transistor 119 of the bleeder circuit, thus increasing the current through resistor 123. When the voltage across resistor 123 becomes greater than 0.7 V, Vbe is less than 0.7 V, and transistor 119 is turned off Therefore, the voltage across resistor 123 is maintained at 0.7 V by the bleeder circuit. In some embodiments of the invention, the resistance of resistor 123, R123, is chosen such that $$R_{123} = \frac{0.7\text{ V}}{I_{hold}}.$$

where $I_{hold}$ is the holding current of the TRAIC. In other words, bleeder circuit 127 is configured to provide compensating loop current $I_{comp}$ to maintain the holding current of the TRIAC.

$$I_{hold} = \frac{0.7\text{ V}}{R_{123}}$$

where R123 is the resistance of resistor 123.

When the loop current is greater than the holding current, Vbe is less than 0.7 V, and transistor 119 cannot be turned on. At this time, the bleeder circuit does not provide the extra current. Note that in FIG. 1, a large inrush current can cause a large reverse voltage Vbe and damage transistor 119. Therefore, a diode 122 is connected between diode 121 and ground to limit the maximum voltage drop on resistor 123 at 1.4 V and to protect transistor 119. In some embodiments, the controller and the bleeder circuit are included in a single integrated circuit (IC). In alternative embodiments, the controller and the bleeder circuit can be included in separate integrated circuit (IC) packages.

Figure 2A:
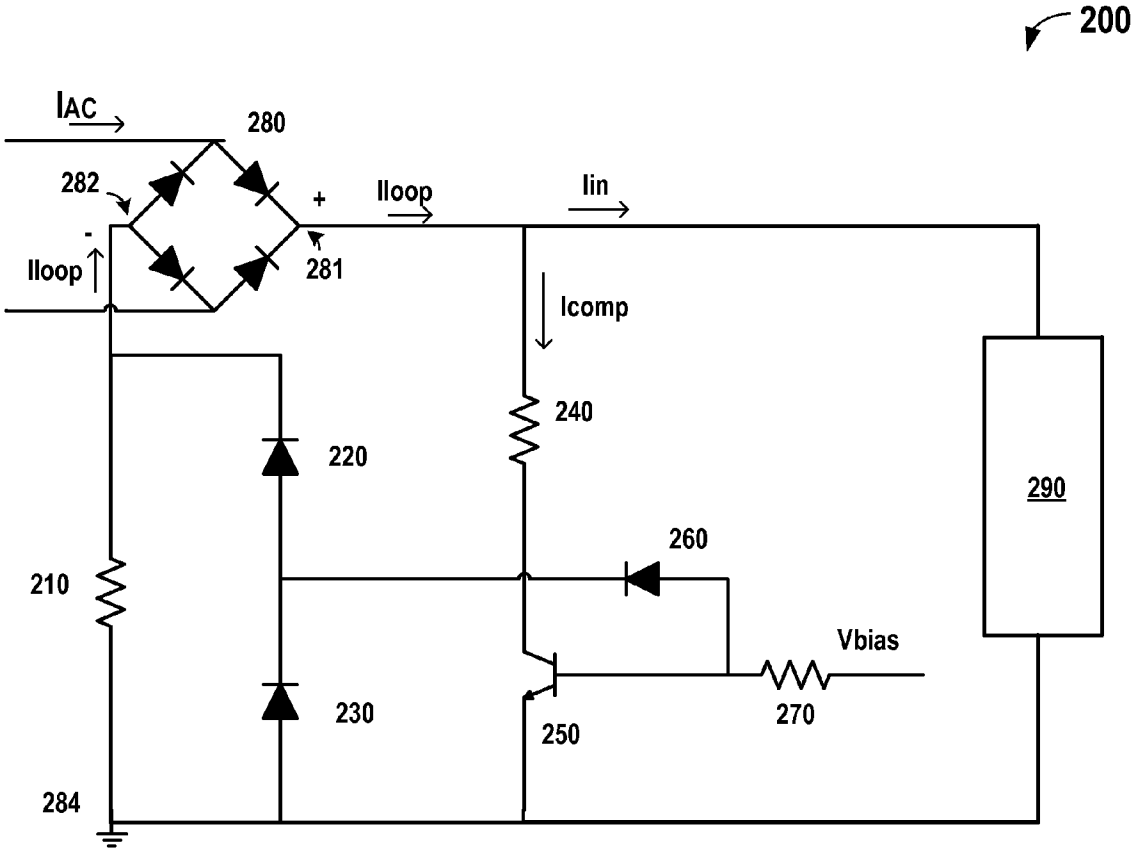
FIG. 2A is a circuit implementation of an active bleeder circuit according to an embodiment of present invention.

FIG. 2A is a circuit diagram illustrating an active bleeder circuit 200 according to an embodiment of present invention. As shown in FIG. 2A, bleeder circuit 200 is similar to bleeder circuit 127 in FIG. 1. Bleeder circuit 200 is configured for maintaining a minimum current flow between a first terminal and a second terminal of a circuit loop. In the embodiment shown in FIG. 2A, the circuit loop includes a first terminal 281 and a second terminal 282. The circuit loop also includes a circuit block 290, which may consume different current at different times, and an internal node 284. In this example, internal node 284 is a ground terminal, but it can also be a node at a different potential. The circuit loop has a loop current Iloop flowing through circuit block 290 between first terminal 281 and second terminal 282. Similar to bleeder circuit 127 in FIG. 1, bleeder circuit 200 is configured for maintaining a minimum current flow in the circuit loop. In an embodiment, when Iloop drops below a minimum current Imin, the bleeder circuit provides a compensation current Icomp in order to maintain Iloop at a minimum current level of Imin.

As shown in FIG. 2A, bleeder circuit 200 includes a first resistor 240 and a bipolar transistor 250 connected in series between the first terminal 281 and an internal node 284 of the circuit loop. The first end of the first resistor is connected to an emitter of the bipolar transistor, and a base of the bipolar transistor 250 is connected to a bias voltage Vbias. Bleeder circuit 200 also includes a second resistor 210 connected between the second terminal 282 of the circuit loop and the internal node 284. Further, a first diode 220 and a second diode 260 are connected in series between the second terminal 282 of the circuit loop and the base of the bipolar transistor 250. In bleeder circuit 200, the resistance of the second resistor 210, R, is selected such that $$R = \frac{V_{d1} + V_{d2} - V_{BE}}{I_{min}}$$

where:

$V_{d1}$ is the forward voltage drop of the first diode 220, $V_{d2}$ is the forward voltage drop of the second diode 260, $V_{BE}$ is the forward base-emitter voltage of the bipolar transistor 250, and $I_{min}$ is the minimum current.

In some embodiments, bleeder circuit 200 also includes a third diode 230 connected between the first diode 220 and an internal node 284.

Figure 2B:
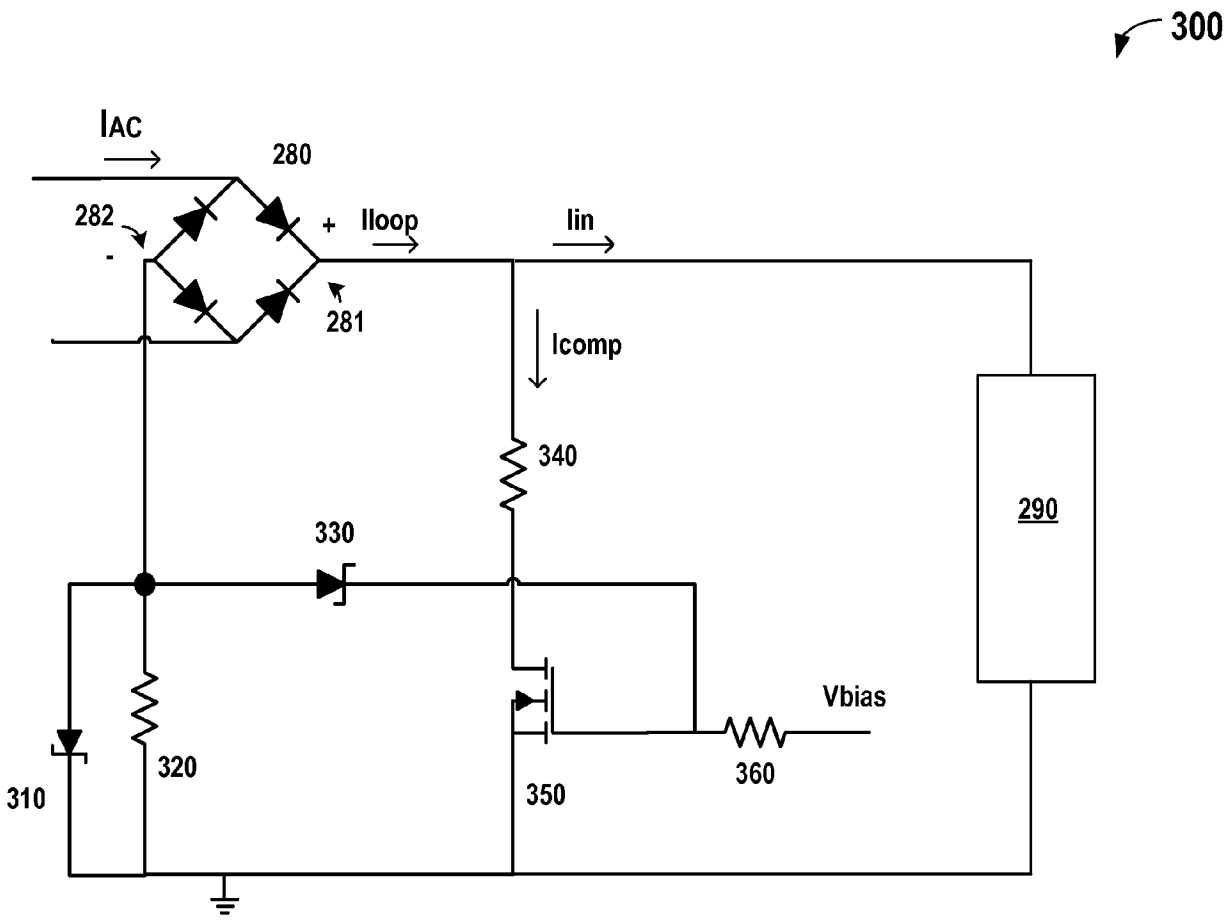
FIG. 2B is a circuit implementation of an active bleeder circuit according to an alternative embodiment of present invention.

FIG. 2B is a circuit diagram illustrating an active bleeder circuit 300 according to an alternative embodiment of present invention. FIG. 2B includes a bridge rectifier 280 having two terminals 281 and 282, and a circuit loop including a load circuit 290. In bleeder circuit 300 of FIG. 2B, the positive terminal 281 of rectifier 295 is coupled to a first resistor 340 and a MOSFET 350 connected in series to ground. The negative terminal of rectifier 282 is coupled to a first Zener diode 310 and a second resistor 320 connected in parallel. A resistor 360 is connected to the gate of MOSFET 350 and a bias voltage Vbias. Further, a second Zener diode 330 connected to the gate terminal of MOSFET 350 and the negative terminal 282 of rectifier. Zener diode 330 is used to clamp the voltage across resistor 320 and the gate-to-source voltage $V_{GS}$ of MOSFET 350, i.e., $$\text{Vzener330} = V_{GS} + V320,$$

wherein V320=R320*Iloop. When Iloop flowing through resistor 320 is reduced, i.e., the drop across the resistor 320, V320, decreases, $V_{GS}$ is increased, and MOSFET 350 is turned on to provide a loop compensation current. The resistance of R320 is selected such that, $$R_{320} = \frac{V_{zener330} - V_{GSTH}}{I_{hold}}$$

where, R320 is the resistance of resistor 320, $I_{hold}$ is the TRIAC holding current, Vzener330 is the Zener voltage of diode 330, and $V_{GSTH}$ is the threshold voltage of MOSFET 350. When the loop current is greater than the holding current, $V_{GS}$ is less than $V_{GSTH}$, and MOSFET 350 cannot be turned on. As a result, no bleeder current is provided.

In FIG. 2B, Zener diode 310 is connected in parallel with current detection resistor 320, between a negative terminal of rectifier bridge 280 and ground, is mainly used for clamping the voltage of resistor 320. When an inrush current is excessively large, Zener diode 310 prevents a large reverse voltage between the gate and source of MOSFET 350, thereby protecting MOSFET 350.

Figure 3A:
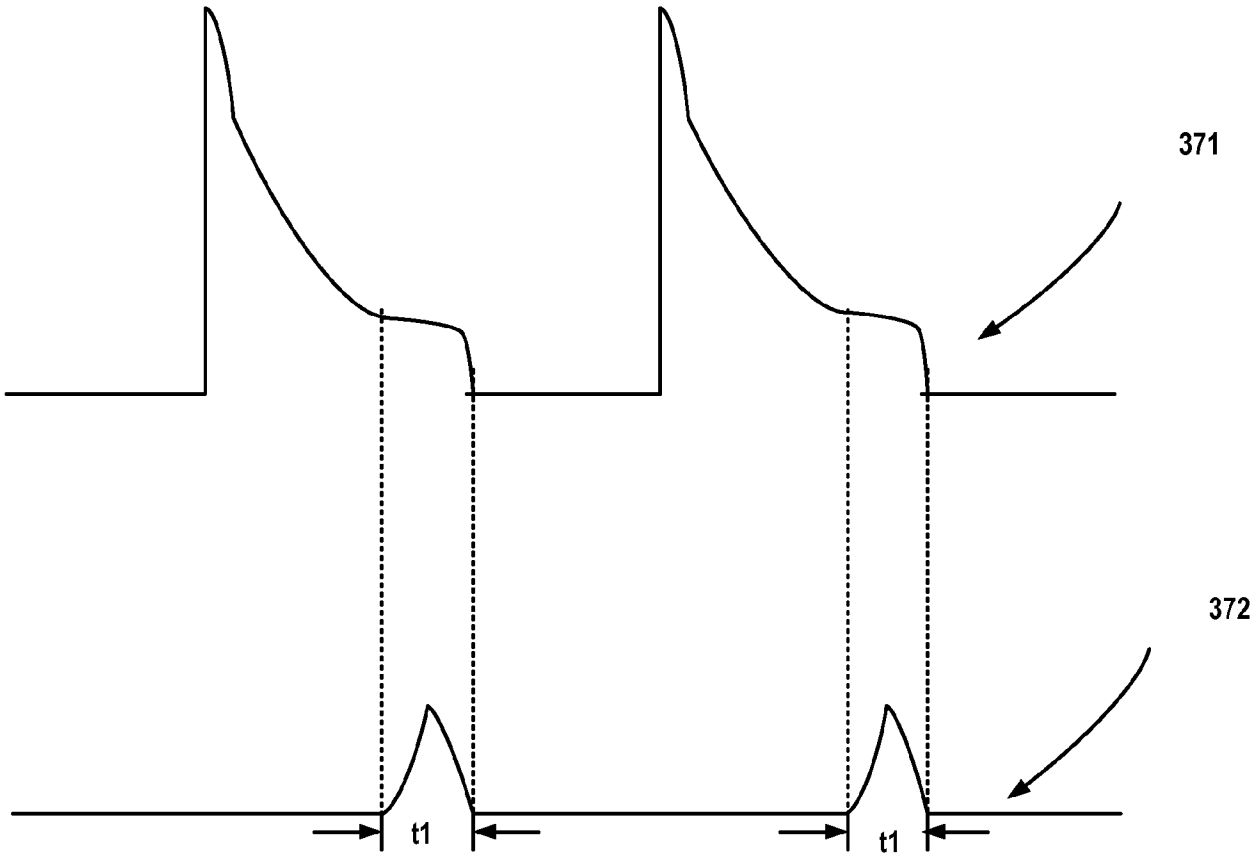
FIG. 3A illustrates the waveform of the output current from rectifier bridge in a power supply having a bleeder circuit but without power factor correction (PFC)

In FIG. 3A, curve 371 illustrates the waveform of the output current from a rectifier bridge 124 in a power supply without power factor correction (PFC). Curve 372 shows the compensation current provided in the bleeder circuit loop when the loop current is below the holding current. The duration of compensation current is shown as t1.

Figure 3B:
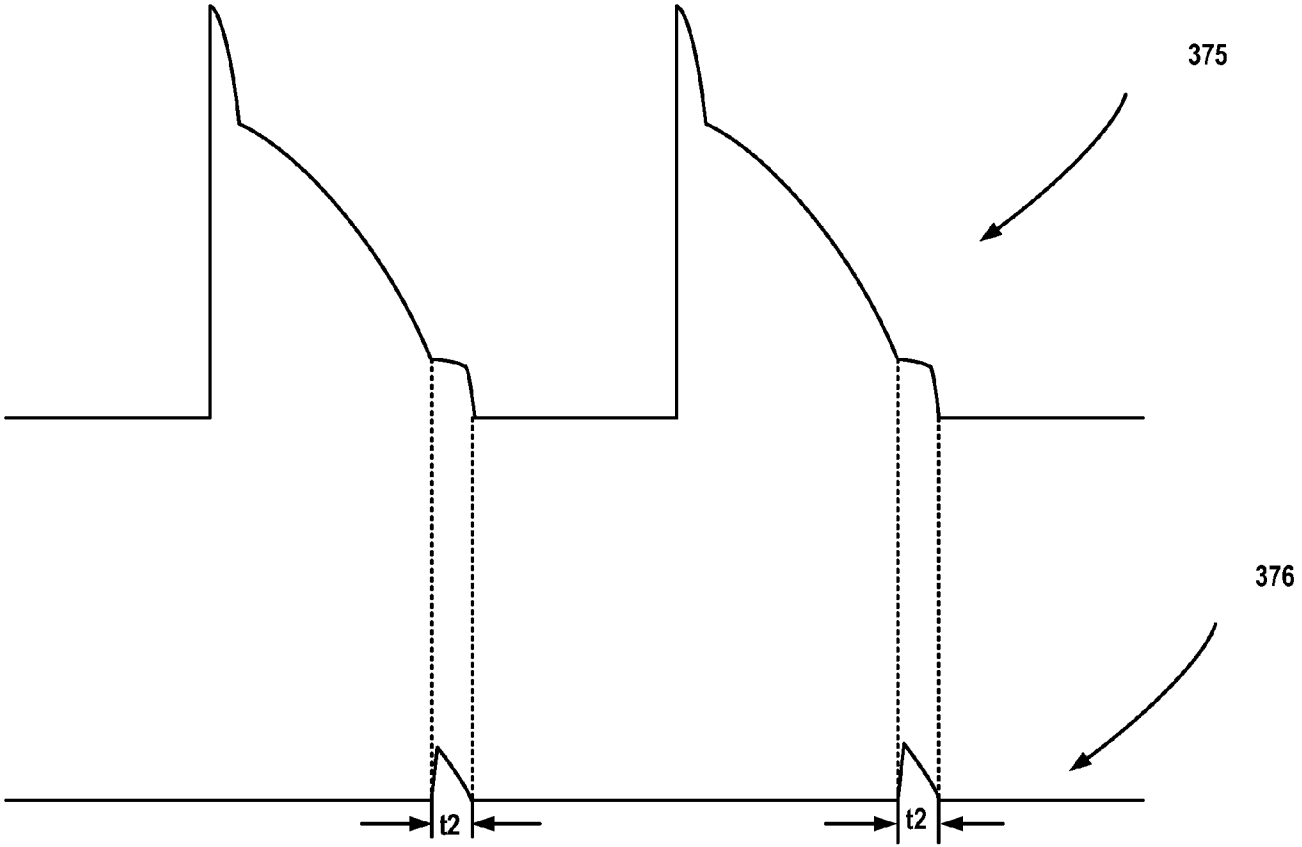
FIG. 3B illustrates the waveform of the output current from rectifier bridge in a power supply having a bleeder circuit and with power factor correction (PFC)

In FIG. 3B, curve 375 illustrates the waveform of the output current from a rectifier bridge in a power supply with power factor correction (PFC). Curve 376 shows the compensation current provided in the bleeder circuit loop when the loop current is below the holding current. The duration of compensation current is shown as t2. In can be seen from FIGS. 3A and 3B that t2<t1. In embodiments of the invention, the power supply includes automatic power factor correction (APFC), which enables the output current to be in phase with the input voltage. It is shown here that power factor correction not only improves the efficiency of the power supply, it can also reduce the compensation current and the duration in which compensation current flows, thereby reducing the power loss in the bleeder circuit.

Figure 3C:
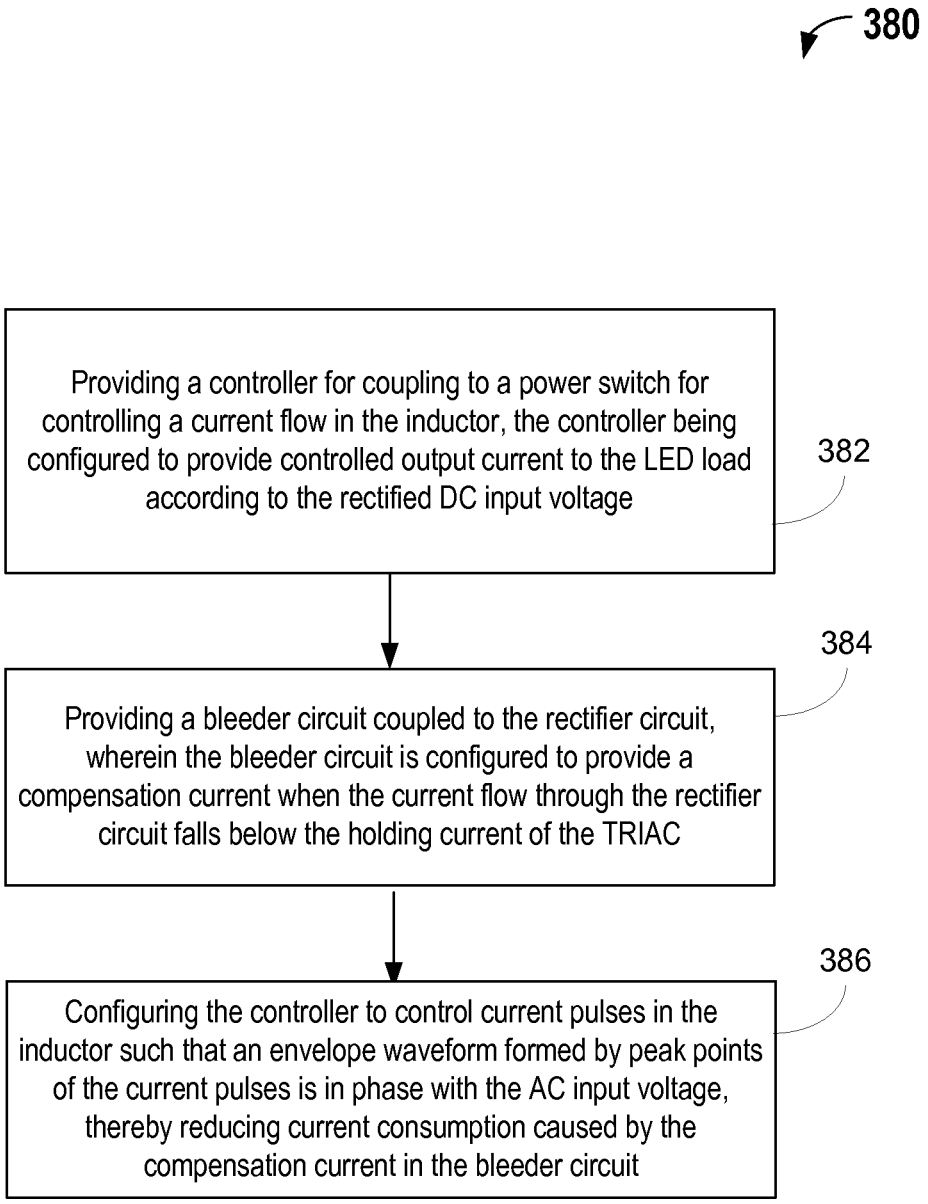
FIG. 3C is a flowchart illustrating a method for reducing bleeder current consumption in a power supply for an LED lighting system including a TRIAC dimmer according to an embodiment of the present invention.

As described above in connection with FIGS. 3A and 3B, embodiments of the present invention provide a method for reducing bleeder current consumption in a switched mode power supply (SMPS) for an LED (light-emitting diode) lighting system. The SMPS includes a rectifier circuit for coupling to an AC input voltage through a TRIAC (Triode for Alternating Current) dimmer. The TRIAC dimmer is characterized by a holding current, and the rectifier circuit having a first output terminal and a second output terminal. The rectifier circuit is configured to provide a rectified DC input voltage to an inductor for supplying power to an LED load. As illustrated in the flowchart in FIG. 3C, the method 380 for reducing bleeder current consumption includes, at step 382, providing a controller for coupling to a power switch for controlling a current flow in the inductor. The controller is configured to provide controlled output current to the LED load according to the rectified DC input voltage. At step 384, the method also provides a bleeder circuit coupled to the rectifier circuit and is configured to maintain a current flow through the rectifier circuit at a magnitude of at least the holding current of the TRIAC. In some embodiments, the bleeder circuit is configured to provide a compensation current when the current flow through the rectifier circuit falls below the holding current of the TRIAC. Moreover, at step 386, the method also includes configuring the controller to control current pulses in the inductor such that an envelope waveform formed by peak points of the current pulses is in phase with the AC input voltage, thereby reducing current consumption caused by the compensation current in the bleeder circuit.

In some embodiments of the above method, the inductor is a primary winding in a transformer in a flyback configuration. In some alternative embodiments of the method, the inductor is a winding in a transformer, and the inductor is connected to the LED load through a diode and a capacitor as shown in the non-isolated configuration in FIG. 1. Further details of the controller and the bleeder circuit are described above in connection with FIGS. 1-3B. Further details of the power factor correction (PFC) function are described below in connection with FIGS. 4A-14.

In embodiments of the invention, LED light systems can be configured to operate with a constant average current and achieve good power factor. In some embodiments, the system can operate in a wide range input AC voltage range under a given power output rating, without having to change parameters of the controller components or additional circuits for supply voltage selection.

In driving an LED lighting system, such as those used in illumination or backlight applications, it is desirable for the power supply to provide a constant current to the LED to maintain a stable brightness. Due to the effect of persistence of vision, human eyes are usually unable to detect brightness changes in a time period shorter than one millisecond. In some embodiments of the present invention, constant brightness can be maintained by a power supply configured to provide a substantially constant average output current at a time scale of 10 milliseconds or longer. In some embodiments, the output current does not have harmonic components with a frequency higher than 100 Hz. In LED driver applications using such power supplies, the brightness of the LED devices can appear to be constant, without brightness variations detectable to the human eye. In a time scale of less then 10 milliseconds, the average output current can be vary with time. The magnitude of the varying current is characterized by an envelope waveform that is in phase with the rectified input AC voltage.

In applications in which the input AC supply is characterized by a partial sinusoidal waveform (for example, when part of the phase angle is cut off by an adjustable dimmer IC), the control circuit of certain embodiments stop energy transfer during the phase region in which the sinusoidal waveform is missing. Thus, the average output current is adjusted according to the ratio of the missing sinusoidal region to the complete sinusoidal waveform, thereby enabling the control circuit to be used with conventional adjustable silicon dimmer devices to control the brightness of the LED. The operation of the power supply system for providing a high power factor in a system with a dimmer is described below using an SMP with a PFM (pulse frequency modulation) flyback converter as an example in conjunction with FIGS. 4A, 4B, 5A, and 5B. It is appreciated that the power factor correction (PFC) functions and implementations described below can be applied to a non-isolated system such as system 100 shown in FIG. 1 and described above in connection with FIGS. 2, 3A, and 3B.

Figure 4A:
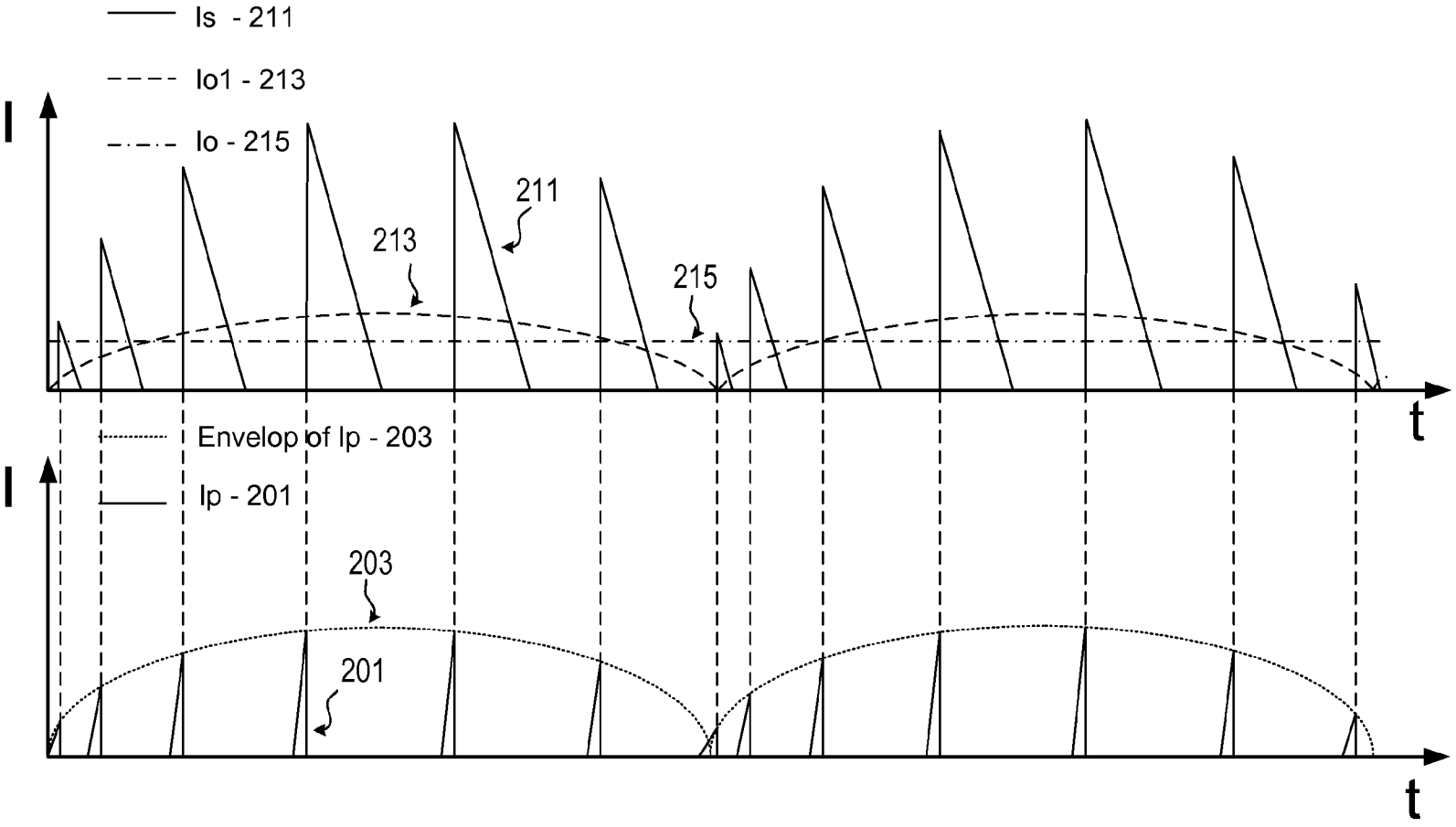
FIG. 4A is a wave form diagram illustrating the waveforms of the primary current and secondary current in an SMPS according to an embodiment of the present invention.

FIG. 4A is a diagram illustrating the waveforms of the primary current and secondary current in an SMPS according to an embodiment of the present invention. In this embodiment, the flyback converter has a transformer with a primary winding and a secondary winding. A power switch is coupled to the primary winding, and an output is provided by the seconary winding. In FIG. 4A, the lower diagram shows the primary current (Ip) pulses 201, which flows only when the power switch is turned on, and an envelope 203 of the peak current of primary current Ip. The upper diagram of FIG. 4A illustrates the waveforms for the secondary current. The instantaneous secondary current 211 flowing through rectifying diode 115 is shown as Is (211). The short duration average current Io1 is shown as 213. The long duration average current 215 is shown as Io. In some embodiments of the present invention, "short duration average" refers to current averaged over a time period shorter than 10 milliseconds, and "long duration average" refers to current averaged over a time period of 10 milliseconds or longer. It can be seen that the short-duration average secondary current pulses 213 is substantially in phase with the envelop of primary current pulses 203. Moreover, the long duration average secondary current 215 is substantially constant.

According to embodiments of the present invention, a method for controlling a switch mode power supply includes selecting a suitable secondary current Is (211) such that the envelop waveform of the average secondary current approaches the shape of Io1 (213) described above. In an embodiment, given the brightness of the LEDs, the average output current Io (215) needed to drive the LEDs can be determined. Then, a short-duration (under 10 msec) average output current Io1 (213) can be derived based on system power factor requirement and the measured AC input voltage phase angle. In an example, the desired waveform for Io1, the short-duration average secondary current, can be expressed as $(1/2)*\pi*Io*|\sin(2\pi ft)|$, where f is the frequency of the rectified AC supply voltage, for example, 100-120 Hz based on commercial AC supply of 50-60 Hz. Based on the profile of secondary current Is and parameters associated with system components such as the transformer, the shape of primary current Ip can be determined as described below.

Figure 4B:
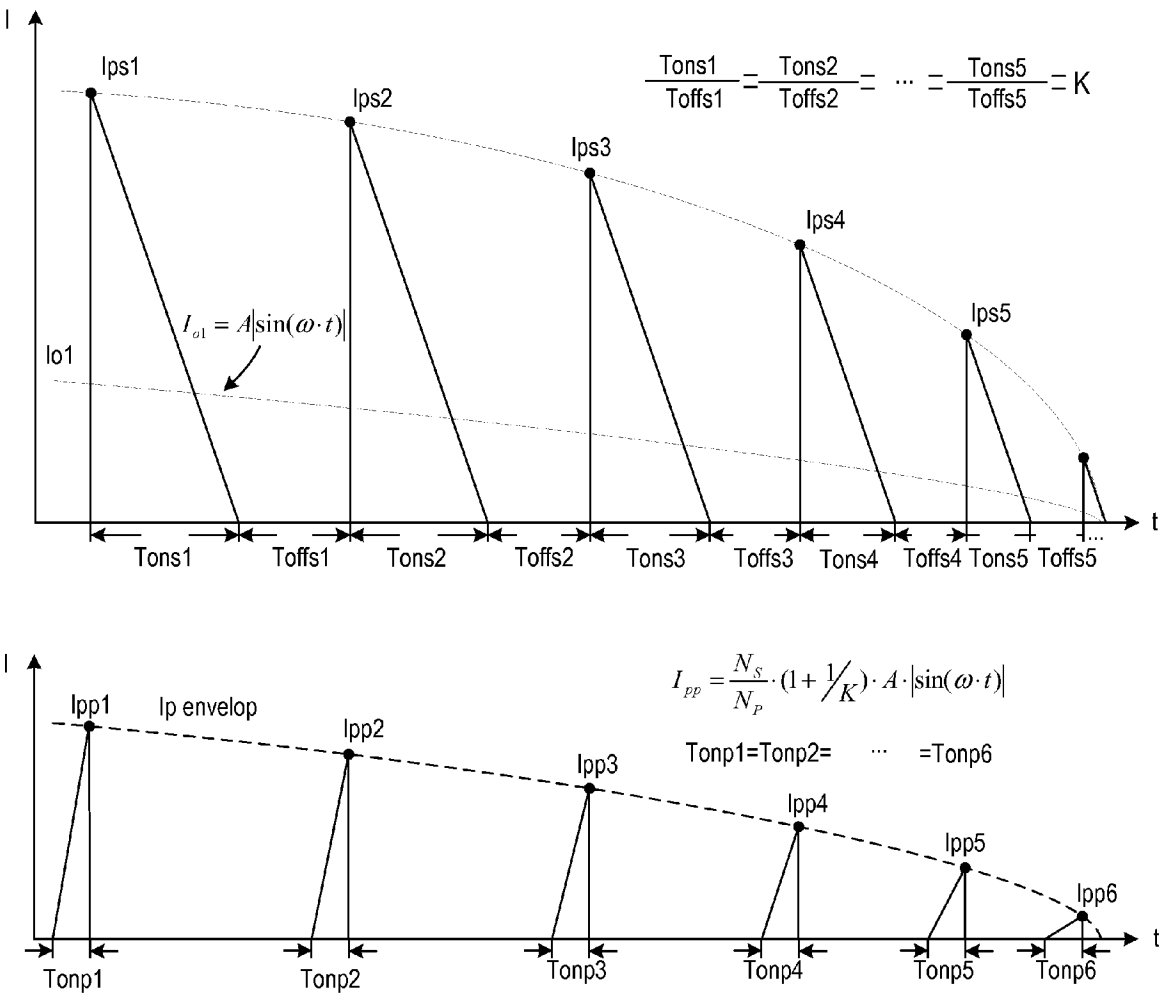
FIG. 4B is waveform diagrams illustrating the on-off time in the primary current and secondary current in an SMPS according to another embodiment of the present invention.

FIG. 4B illustrates the on-off times in the primary current and secondary current in an SMPS according to an embodiment of the present invention. Here, the turn-on time of the power switch is based on the required secondary current, and the duration of power switch conduction time is based on the envelop of peak primary current. As shown in the upper diagram of FIG. 3, the ratio of secondary side conduction time Tons to cutoff time Toff, Ton/Toff, is maintained at a constant K by the power supply controller. Let the envelop waveform of peak points of secondary current Ips(t) be described by equation (1), $$Ips(t)=(1+1/K)*(½)*\pi*Io*|\sin(2\pi ft)| \quad (1)$$

Then, the short-duration (less than 10 msec) average of secondary current can be described by equation (2), $$Io1=(½)*Io*\pi*|\sin(2\pi ft)| \quad (2)$$

In long-duration time scale, the average system output current is shown as equation (3), $$(f)*\int_0^{1/f}(Io1)dt=(f)*(½)*\pi*Io*\int_0^{1/f}|\sin(2\pi ft)|dt=Io \quad (3)$$

In order to satisfy equation (1), the peak points of primary current Ipp(t) need to be included in the envelop waveform described by equation (4), $$Ipp(t)=(Ns/Np)*(1+1/K)*(½)*\pi*Io*|\sin(2\pi ft)| \quad (4)$$

where Ns and Np are coil turn numbers of the secondary coil and the primary coil of the transformer, respectively. Thus, according to embodiments of the invention, by controlling primary side peak current Ipp(t) as prescribed by equation (4), the power supply can be configured to provide a constant average drive current to a load, such as a string of LEDs with a good power factor.

Let Va(t) denote the amplitude of the rectified input AC voltage, then the rectified input voltage can be expressed as follows:

$$Vin(t)=Va(t)*|\sin(2\pi ft) \quad (5)$$

The on time of the primary conduction can be determined according to equation (5) and the target primary peak current Ipp(t) described above, Vin(t)=Lp*Ipp(t)/Tonp, where Lp is the inductance of the primary winding. Since the on time of primary current is determined to provide the desired secondary output current, the magnitude of the AC source voltage Vs would not affect the output of the SMPS. Therefore, the same controller can be used with different AC sources, for example, 110V or 220V.

In systems without a dimmer device, Va in equation (5) is a time-independent constant without a dimmer. In systems with a dimmer device, Va(t) may be zero in certain range of phase angle. In applications with a dimmer, Va(t) is zero during certain phase range. The controller can turn off the switch to prevent conducting when Va(t) is zero. In embodiments of the invention, the envelop of peak primary current Ipp(t) is proportional to Vin(t), regardless of the presence of a dimmer Without a dimmer, Vin(t) is a complete rectified sinusoidal curve, and the envelop of Ipp(t) is also a complete rectified sinusoidal curve. With a dimmer, Vin(t) is an incomplete rectified sinusoidal curve, and the envelop of Ipp(t) is also an incomplete rectified sinusoidal curve, with the same dimmed phase angles Thus, in some embodiment, a high system power factor can be achieved and simultaneously allow the output average current to be controlled by the dimmer.

Figure 5A:
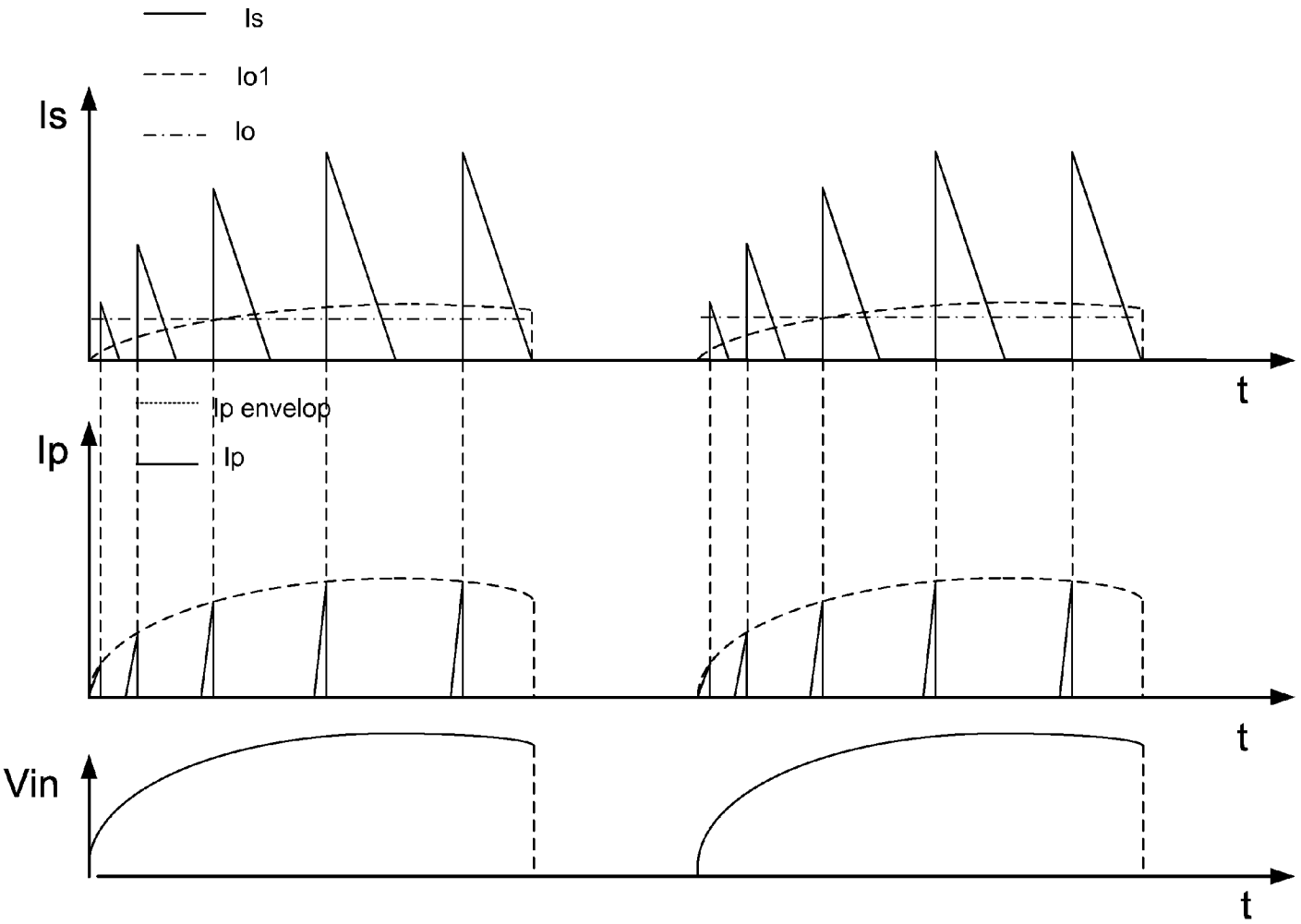
FIGS. 5A and 5B are waveform diagrams illustrating the on-off time of the primary current and secondary current in an SMPS operating with a dimmer device according to an embodiment of the present invention.
Figure 5B:
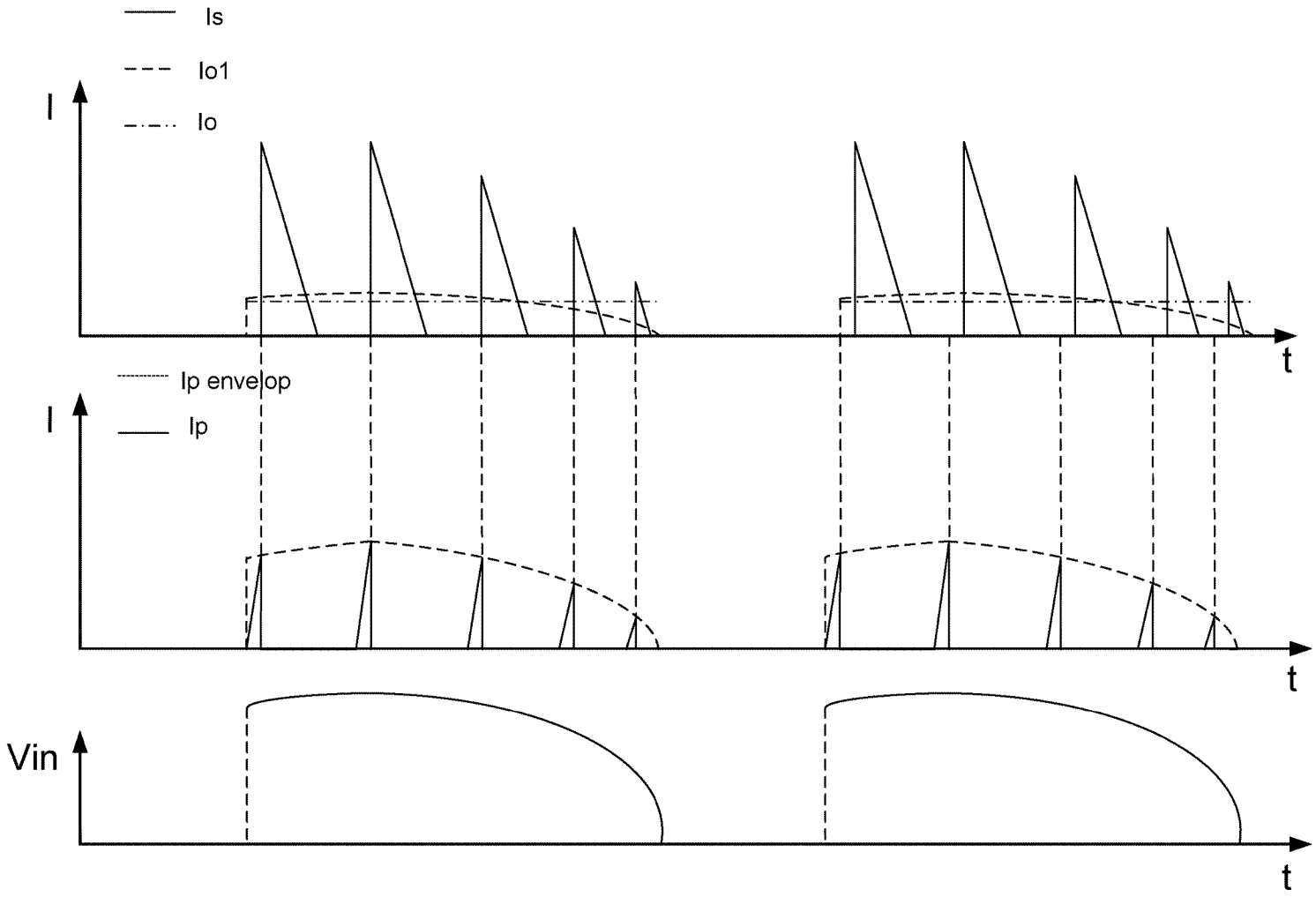

FIGS. 5A and 5B are waveform diagrams illustrating the on-off time of the primary current and secondary current in an SMPS operating with a dimmer circuit according to an embodiment of the present invention. As shown in FIGS. 5A and 5B, Vin is the rectified input voltage, Vp is the primary current, and Vs is the secondary current. Certain phase angles of rectified sinusoidal curve Vin are cut off by a dimmer device. In FIG. 5A, the input AC input voltage is cut off by the dimmer in a latter portion of the AC cycle, and in FIG. 5B, the input AC input voltage is cut off by the dimmer in a front portion of the AC cycle. It can be seen that in both cases, the envelops of the primary and secondary current pulses are in phase with the AC input voltage.

Figure 6:
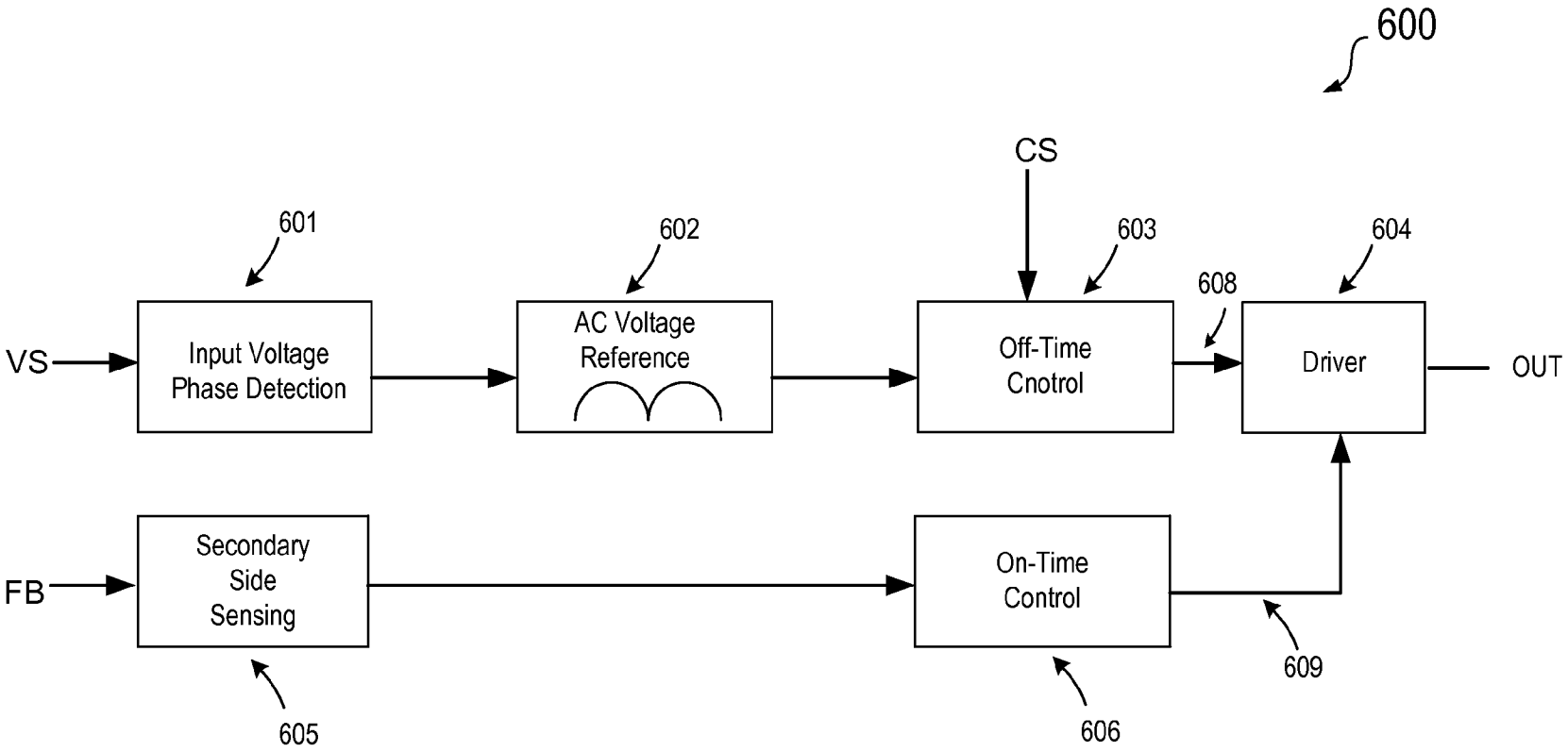
FIG. 6 is a simplified block diagram illustrating part of a power supply controller 600 according to an embodiment of the present invention.

FIG. 6 is a simplified block diagram illustrating part of a power supply controller 600 according to an embodiment of the present invention. In some embodiments, controller 600 can be used as controller 126 in power supply 100 in FIG. 1. In some embodiments, controller 600 is a single-chip controller having six terminals:

- rectified input voltage sense terminal (VS), which corresponds to PD in FIG. 1;
- secondary side feedback terminal (FB);
- primary side current sense terminal (CS); and
- output terminal for driving a power switch (OUT).
- power terminal (VCC)—not shown in FIG. 6;
- ground terminal (GND)—not shown in FIG. 6;

As shown in FIG. 6, controller 600 includes an input voltage phase detection module 601 coupled to the VS terminal for detecting the phase angle of the rectified input voltage Vin as shown in FIG. 1. Input voltage phase detection module 601 is coupled to an AC voltage reference module 602, which is configured for generating a reference voltage signal that has the same phase angle as the input AC voltage to the power supply Vac. As shown in FIG. 1, Vin is derived from rectifying circuit 105 and capacitor 112. To facilitate phase detection of Vin, it is desirable for Vin to retain certain time varying characteristic of Vac. Therefore, a relatively low capacitance is selected for capacitor 112. In some embodiments, the capacitance of capacitor 112 can be between 10 nF to 100 nF. In contrast, in some conventional power supplies, the rectifying capacitor can have a capacitance on the order of 5 uF. Of course, depending on the embodiments, capacitor 112 can be larger than 100 nF or smaller than 10 nF.

In FIG. 6, an off-time control module 603 is coupled to AC voltage reference module 602 to receive the reference voltage, and it is also coupled to the CS pin to receive the primary side current sense signal. Off-time control module 603 provides a first signal 608 to a driver module 604. Moreover, a secondary side sensing module 605 is couple to the FB pin to receive a feedback signal FB, which is related to the output condition on the secondary side. Secondary side sensing module 605 is coupled to an on-time control module 606, which provides a second signal 609 to driver module 604. As shown in FIG. 6, driver module 604 is coupled to the OUT pin to provide a control signal OUT for controlling the power switch. In a specific embodiment, controller 600 can be implemented in a low cost package, such as an SOT23-6 package.

Figure 7:
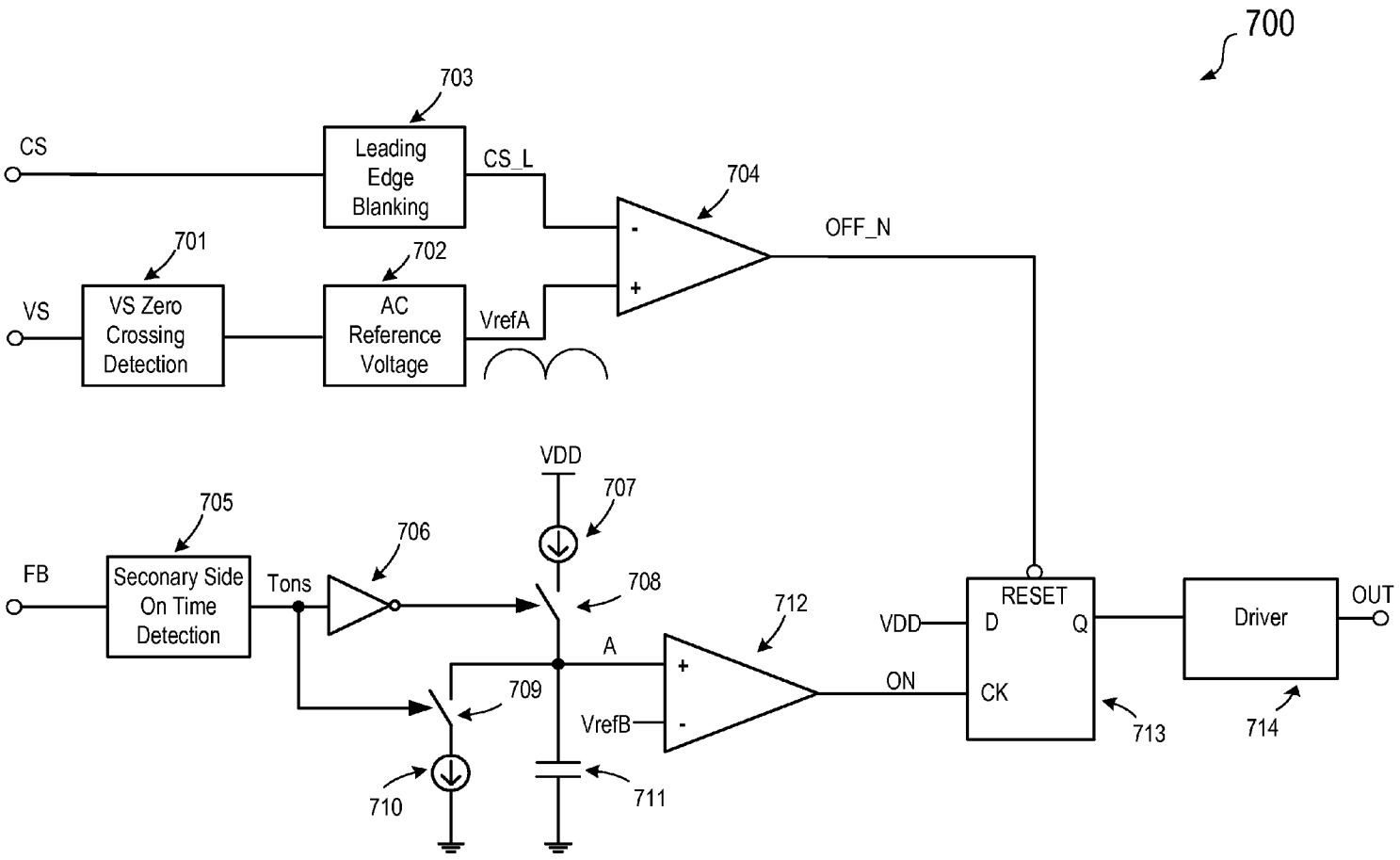
FIG. 7 is a simplified schematic/block diagram illustrating part of a power supply controller according to another embodiment of the present invention.
Figure 8:
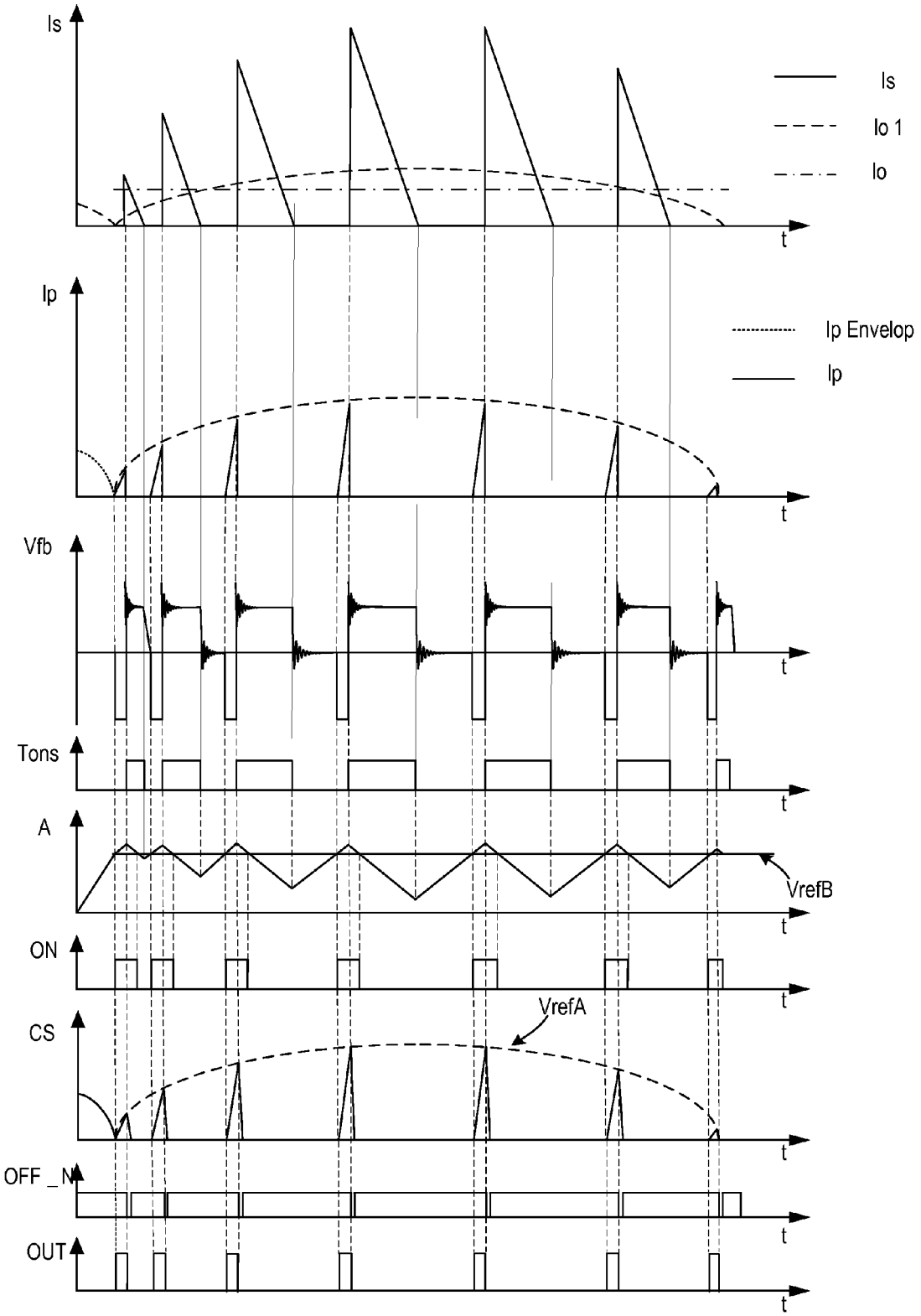
FIG. 8 show exemplary waveforms illustrating the operation of the power supply controller of FIG. 7 according to an embodiment of the present invention.

FIG. 7 is a simplified schematic/block diagram 700 illustrating part of a power supply controller 700 according to another embodiment of the present invention. FIG. 8 shows exemplary waveform diagrams illustrating various signals during the operation of the power supply controller in FIG. 7. In FIG. 7, VS zero crossing detection circuit 701 is coupled to AC reference voltage circuit 702 to output a reference voltage VrefA, which is a rectified sinusoidal signal having the same phase angle as rectified input signal at terminal VS. VrefA is coupled to the positive input of comparator 704. A leading edge blanking circuit 703 receives primary side current sense signal CS and provides a modified sense signal CS_L to the negative input of comparator 704. When CS_L reaches reference voltage VrefA, the power switch is to be turned off. At this time, comparator 704 outputs an OFF_N signal, which provides a negative pulse to reset D trigger circuit 713. In an embodiment, VrefA is related to the desired envelop waveform of peak primary current pulses as described in equation (4). Comparator 704 is configured to ensure that the peak current pulses conform to the desired envelop waveform.

In FIG. 7, secondary side on-time detection circuit 705 receives feedback signal Vfb at the FB pin from the secondary side and outputs a signal Tons, which reflects the on condition of the secondary side rectifier. For example, Tons is set at a high voltage level when the secondary side current is flowing. A high voltage level of Tons turns on switch 709 and, through inverter 706, turns off switch 708, causing a capacitor 711 to discharge through constant current source 710. On the other hand, when the secondary side rectifier is turned off, Tons is at a low voltage level, switch 709 is turned off, and switch 708 is turned on, causing capacitor 711 to be charged through constant current source 707. As shown in FIG. 7, comparator 712 is coupled to capacitor 711 to receive capacitor voltage A and a reference voltage VrefB. When voltage A of capacitor 711 reaches reference signal VrefB, the comparator output signal ON becomes high and causes the output Q of D trigger circuit 713 to be high, which, through driver circuit 714, produce a control signal OUT for turning on the power switch. Here, VrefB is selected such that the charging and discharging curve of capacitor 711 is described by a triangular waveform. Under this condition, the ratio of secondary side rectifier on-time to off-time "K" is a constant determined by current sources 707 and 710.

Figure 9:
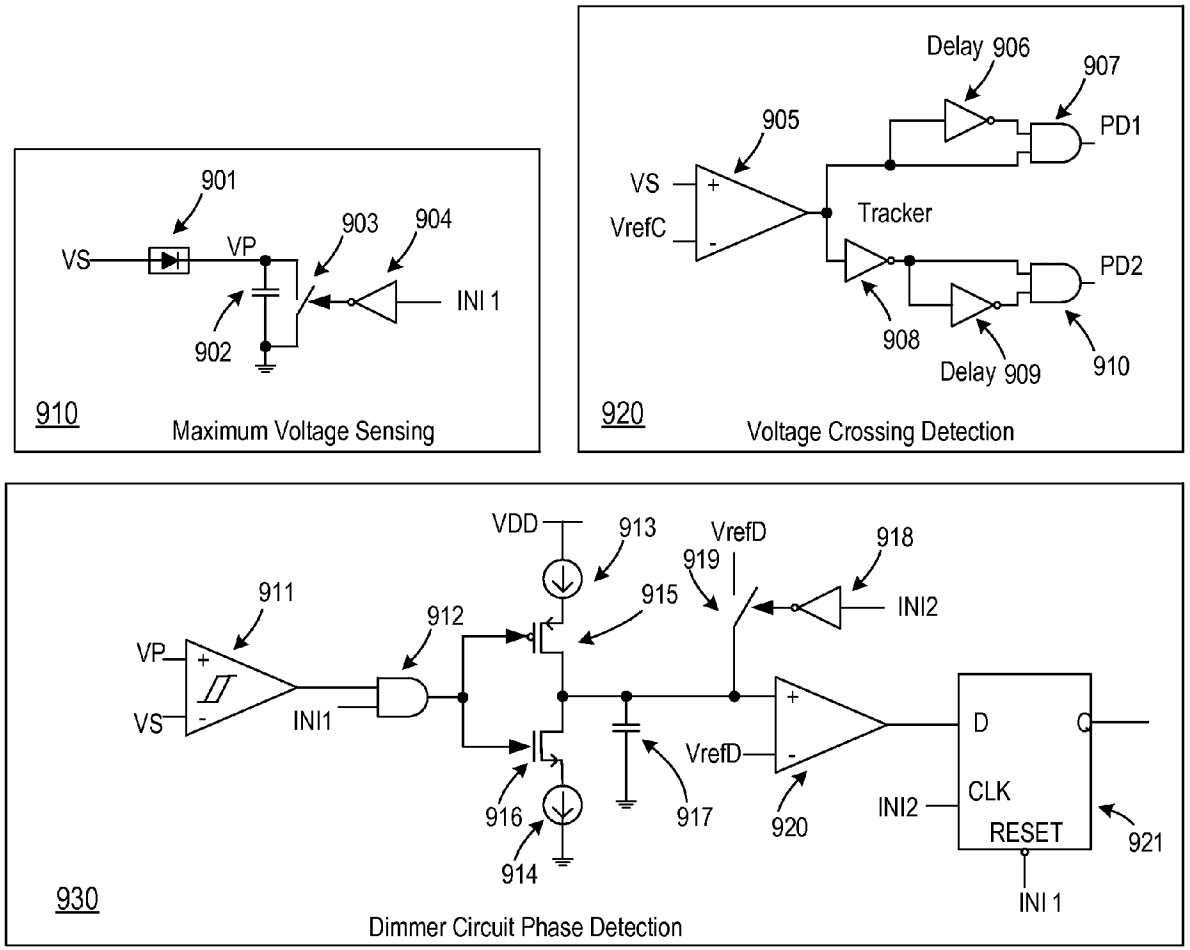
FIG. 9 shows simplified circuit diagrams illustrating circuit modules that can be used in zero crossing detection circuit of FIG. 7 according to an embodiment of the present invention.

FIG. 9 shows simplified circuit diagrams illustrating circuit modules that can be used in zero crossing detection circuit 701 of FIG. 7 according to an embodiment of the present invention. In FIG. 9, maximum voltage sensing module 910 includes a diode 901, a capacitor 902, a switch 903, and an inverter 904. Input voltage VS is coupled to capacitor 902 through diode 901. As VS rises, the voltage VP at capacitor 902 is charged up and follows VS. When VS reaches its maximum and starts to fall, diode 901 disconnects VS from capacitor 902, and VP is maintained by capacitor 902. Thus, the maximum voltage of VS in a cycle is recorded at capacitor 902. As also shown in circuit block 910, capacitor 902 can be discharged through switch 903 under the control of signal INI1 through inverter 904.

In FIG. 9, voltage crossing detection module 920 includes a comparator 905, which is coupled to VS at its positive input terminal and coupled to a reference voltage VrefC at its negative input terminal. The output signal of comparator 905 is labeled Tracker, which changes states when VS crosses VrefC, i. e., when VS changes from being higher than VrefC to being lower than VrefC, or vice versa. A delay circuit 906 and an AND gate 907 are used to produce a pulse signal PD1 when VS rises from a low level to a high level and crosses VrefC. Similarly, an inverter 908, a delay circuit 909, and an AND circuit 910 are used to produce a second pulse signal PD2 when VS drops from a high level to a low level and crosses VrefC.

Figure 10:
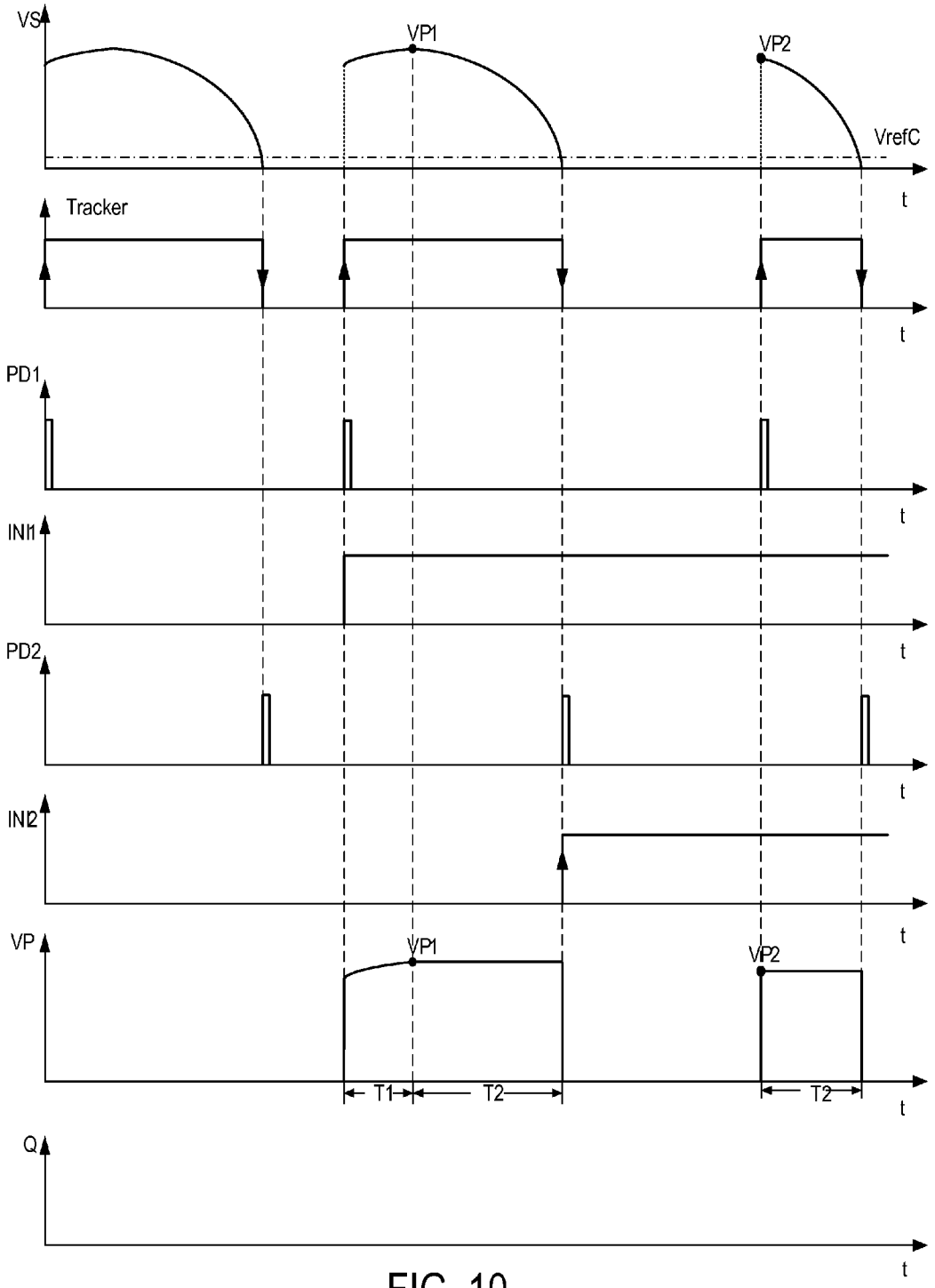
FIGS. 10 and 11 are waveform diagrams illustrating various signals associated with the circuits depicted in FIG. 9.
Figure 11:
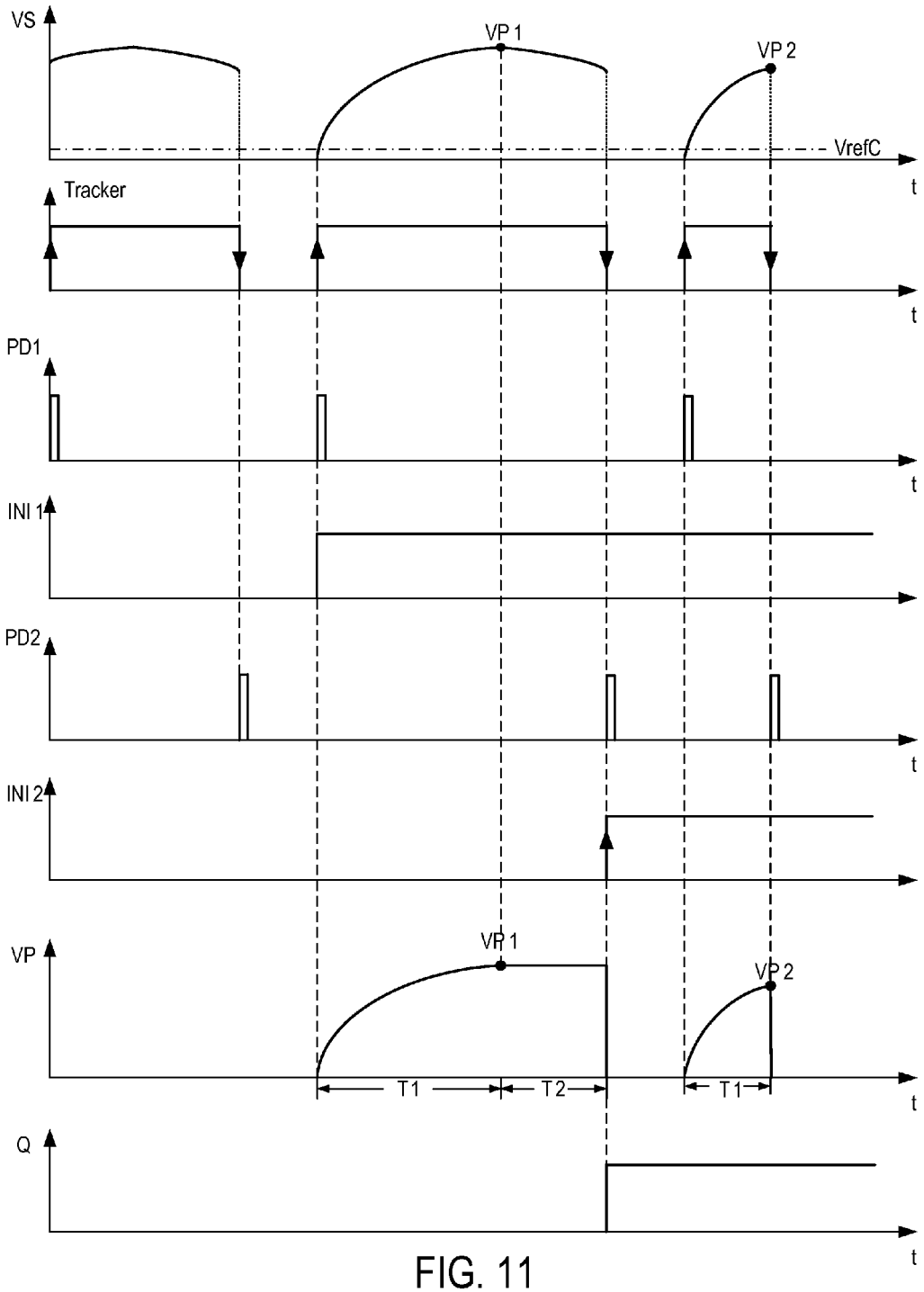

FIGS. 10 and 11 are waveform diagrams illustrating of the time variation of the signals associated with the circuits depicted in FIG. 9. FIG. 10 shows the signal waveforms when a front part of the AC input voltage is cut off by the dimmer circuit (also referred to as "front cut"), and FIG. 11 shows the waveforms when a latter part of the AC input voltage is cut off by the dimmer circuit (also referred to as "back cut"). Here, the waveform over a complete cycle of the input AC input voltage is used to determine whether a front portion or the latter portion of the AC voltage is cut off. As shown in FIGS. 10 and 11, signal INI1 goes from low to high when signal PD1 (or PD2) pulse arrives. INI2 goes from low to high when the next PD2 (or PD1) pulse arrives after INI1 has become high.

In an embodiment, VrefC in voltage crossing detection circuit 920 in FIG. 9 is selected to be close to zero, such that comparator 905 can determine zero crossing of VS. In FIGS. 10 and 11, T1 is the time it takes for VS to increase from VrefC to the peak VS voltage (designated as VP), and T2 is the time it takes for VS to decrease from VP to VrefC. If T1 is greater than T2, then it can be determined that a latter portion of the AC input voltage is chopped off. Conversely, If T1 is smaller than T2, then it can be determined that a front portion of the AC input voltage is chopped off.

In FIG. 9, dimmer circuit phase detection circuit 930 includes a comparator 911, with its positive input coupled to peak voltage VP produced by maximum voltage sensing circuit 910 and its negative input coupled to VS. The output of comparator 911 can be used to determine the duration in which VS rises from VrefC to VP and the duration in which VS falls from VP to VrefC. The output of comparator 911 is coupled to an AND gate 912, which also has signal INI1 as another input. A low comparator output voltage and a high INI1 signal indicate VS is in the process of rising from VrefC to VP. At this time, switch 916 is turned off and switch 915 is turned on, causing capacitor 917 to be charged by current source 913. Conversely, a high comparator output voltage and a high INI1 signal indicate VS is in the process of falling from VP to VrefC. At this time, switch 916 is turned on and switch 915 is turned off, causing capacitor 917 to be discharged by current source 914.

When INI2 signal is low, the positive input of comparator 920 is initially set to VrefD. During the time when Tracker is high, comparator 920 output signal can reflect the length of charging and discharging time, and the two time periods T1 and T2 described above. The output of comparator 920 is coupled to D trigger circuit 921, which is also coupled to INI2 at its clock terminal CLK. When the INI2 signal changes from low to high, the CLK terminal triggers the D trigger circuit and the output signal of comparator 920 enters the D terminal of the D trigger and is locked. Assuming the dimmer circuit cuts off the latter part of the input voltage cycle, it takes longer for VS to rise from VrefC to peak voltage VP than to fall from VP to VrefC. Under this condition, the output of comparator 920 is high, and the output of D trigger 921 is locked at high, indicating that pulse signal PD1 should be used to determine the zero-crossing of the input AC voltage. Conversely, if the dimmer circuit cuts off the early part of the input voltage cycle, the pulse signal PD2 should be used. The waveform diagrams of these signals are illustrated in FIGS. 10 and 11.

Figure 12B:
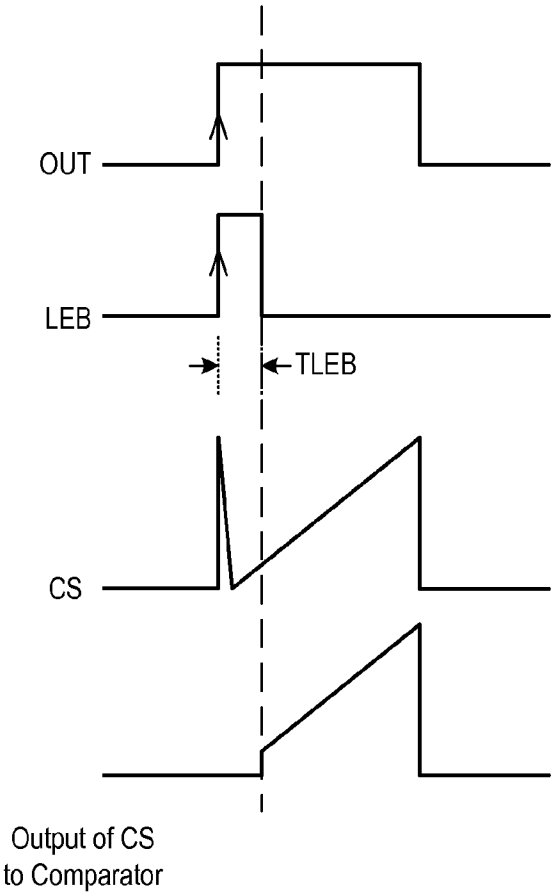
FIG. 12B is a waveform diagram illustrating the signals in the leading edge blanking circuit in FIG. 12A.
Figure 12A:
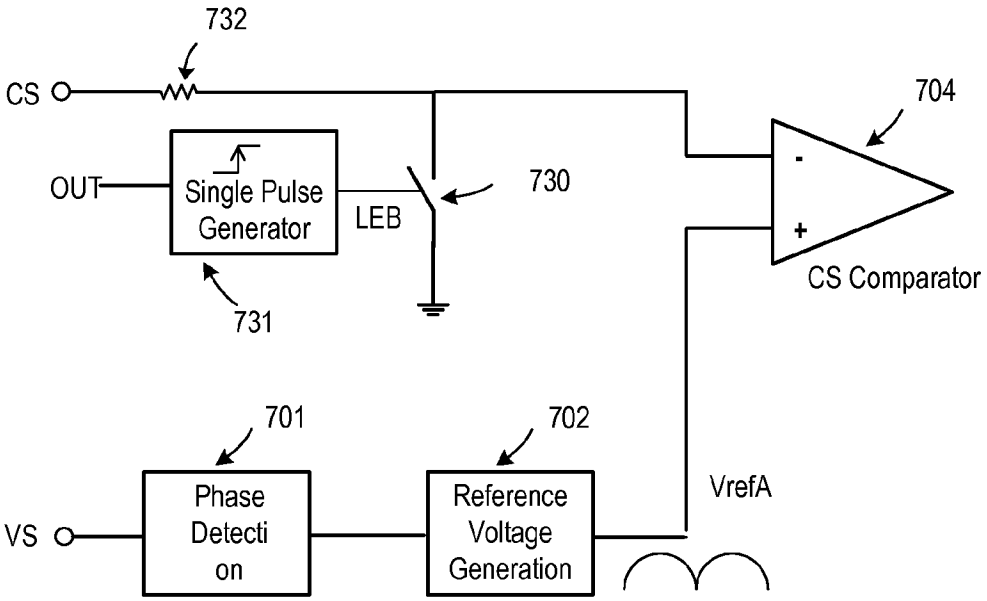
FIG. 12A is a simplified block/circuit diagram illustrating an exemplary implementation of the leading edge blanking circuit in FIG. 7 according to an embodiment of the present invention.

FIG. 12A is a simplified block/circuit diagram illustrating an exemplary implementation of the leading edge blanking circuit 703 in FIG. 7 according to an embodiment of the present invention. FIG. 12B is a waveform diagram illustrating various signals in FIG. 12A. FIG. 12B illustrates a spike in the CS signal, which represents the current in the power switch. The spike occurs at the leading edge of the OUT signal pulse, when the power switch changes from an off state to an on state. Leading edge blanking circuit block 703 in FIG. 7 is configured to filter this spike from the CS signal, with details depicted in FIG. 12A. As shown in FIG.

12A, a resistor 732 and a switch 730 are disposed between the CS signal and comparator 704. Switch 730 connects the CS signal to ground under the control of a pulse signal LEB, which is triggered at the leading edge of the OUT signal and lasts for a short duration TLEB. As shown in FIG. 12B, the spike in the CS signal is removed before it reaches comparator 704.

Figure 13:
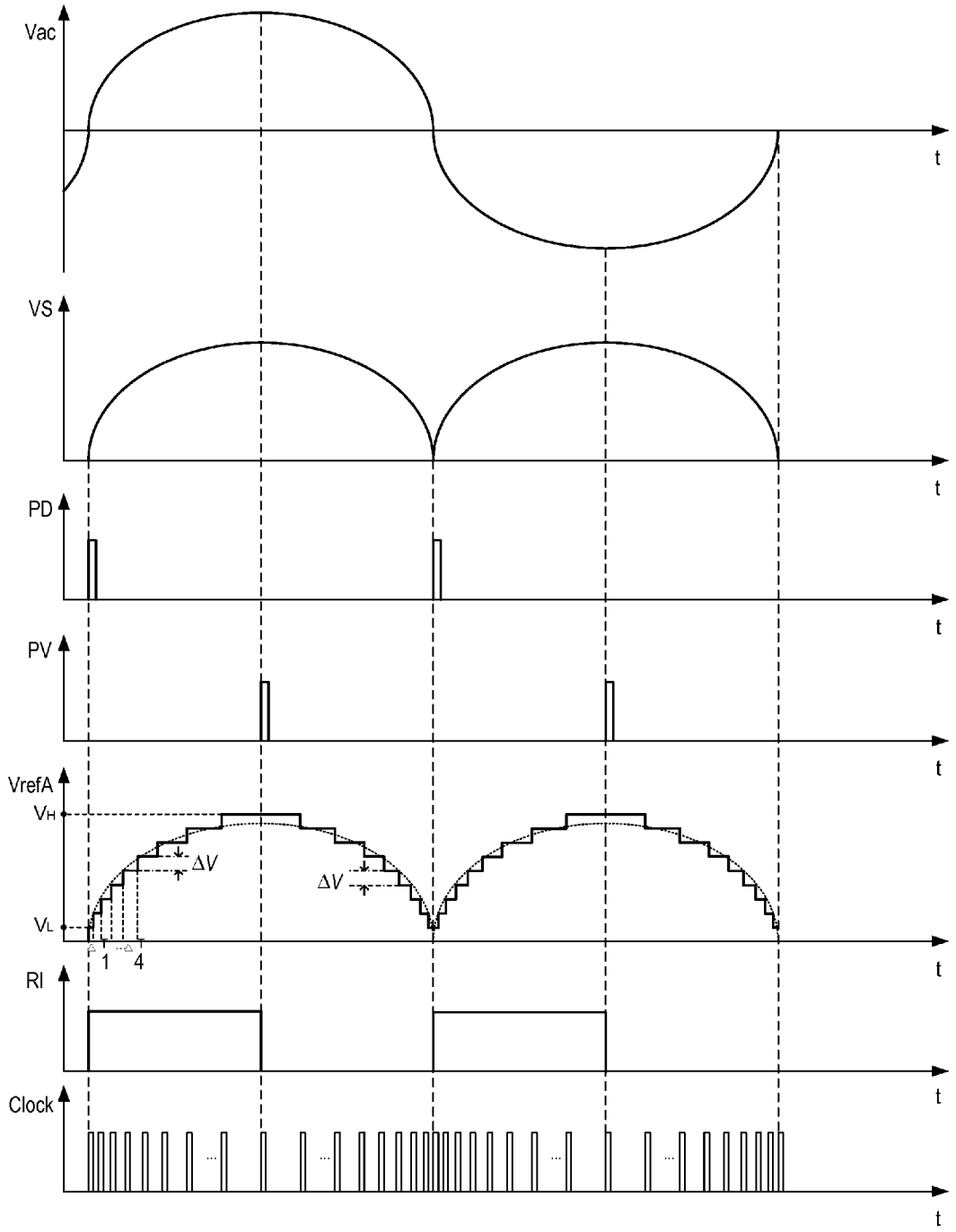
FIG. 13 is a waveform diagram illustrating the signals involved in the generation of AC reference signal according to an embodiment of the present invention.

FIG. 13 is a waveform diagram illustrating the various signals involved in the generation of AC reference signal according to an embodiment of the present invention. In FIG. 13, Vac is the AC input voltage to the power supply system and can be provided through, for example, a power outlet in a city power system. VS is the rectified AC signal, and PD and PV are pulse signals indicating the zero-crossing point and the peak point of Vac, respectively. RI is a signal derived from PD and PV. Here, a high level of RI indicates the time period in which the AC reference signal rises from a minimum VL to a maximum VH. Conversely, a low level of RI indicates the time period in which the AC reference signal rises from the maximum VH to the minimum VL. In FIG. 13, Clock is a pulse signal having a fixed pulse width, but variable frequency. The Clock signal is derived from the rectified input voltage Vin at terminal VS and is used for generating the VrefA signal, which has the same phase as Vin. The Clock signal is used in controlling the charging of a capacitor for the generation of the VrefA reference signal. When RI is high, every Clock pulse causes the capacitor to be charged higher by a fixed voltage ΔV. Conversely, when RI is low, every Clock pulse causes the capacitor to be discharged lower by a fixed voltage ΔV. Thus, the frequency of the Clock pulse determines the rising and falling shapes of reference signal VrefA. As a result, VrefA will follow the shape of VS and maintain the same phase angle as VS.

Figure 14:
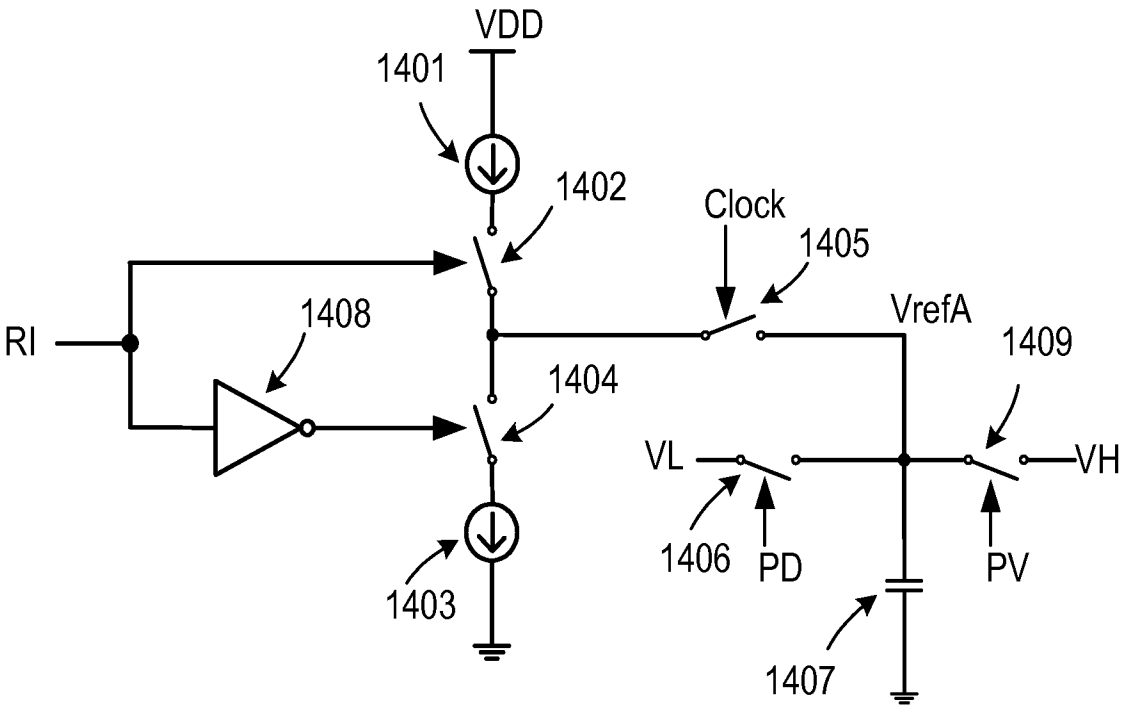
FIG. 14 is a simplified circuit diagram illustrating a circuit for generating the AC reference voltage as depicted in FIG. 13.

FIG. 14 is a simplified circuit diagram illustrating a circuit for generating the AC reference voltage as described in FIG. 13. As shown, circuit 1400 includes current sources 1401 and 1403 providing equal current for charging and discharging capacitor 1407. Current sources 1401 and 1403 are controlled by switches 1401 and 1404, respectively, which in turn are controlled by an input signal RI and inverter 1408. When RI is high, switch 1402 is on and switch 1404 is off. Under this condition, every Clock pulse causes current source 1401 to charge capacitor 1407 by a fixed amount of electric charges Q=I*Ton, and causes VrefA to rise by a voltage ΔV=Q/C, where I is the current in current sources 1401 and 1403, Ton is the on time, or the pulse width, of the Clock pulse, and C is the capacitance of capacitor 1407. Conversely, when RI is low, switch 1401 is on and switch 1402 is off. Every Clock pulse causes current source 1403 to discharge capacitor 1407 by a fixed amount of electric charges Q=I*Ton, and causes VrefA to fall by a voltage ΔV=Q/C. By controlling the frequency of the Clock pulse, VrefA can be generated exhibit the shape of a rectified sinusoidal wave.

The above description includes specific examples used to illustrate various embodiments. It is understood, however, that the examples and embodiments described herein are for illustrative purposes only. Various modifications or changes in light thereof will be suggested to persons skilled in the art and are to be included within the spirit and purview of this invention.

What is claimed is:

1. A control circuit for an LED (light-emitting diode) lighting system that includes a rectifier circuit for coupling to an AC input voltage through a TRIAC (Triode for Alternating Current) dimmer, the TRIAC dimmer being characterized by a holding current, the rectifier circuit being configured to provide a rectified DC input voltage to an inductor for supplying a constant current to an LED load, the control circuit comprises:

a controller for coupling to a power switch for controlling a current flow in the inductor, the controller being configured to control current pulses in the inductor such that an envelope waveform formed by peak points of the current pulses is in phase with the AC input voltage; and a bleeder circuit coupled to the rectifier circuit, wherein the bleeder circuit is configured to determine if that a current flow through the rectifier circuit is below the holding current of the TRIAC; and wherein the bleeder circuit is configured to provide a compensation current, upon determining that the current flow through the rectifier circuit is below the holding current of the TRIAC, to maintain a current flow through the rectifier circuit at a magnitude of at least the holding current of the TRIAC;

wherein the bleeder circuit comprises:

a first resistor and a bipolar transistor coupled in series between the first output terminal of the rectifier circuit and a ground, a base of the bipolar transistor being coupled to a bias voltage;

a second resistor coupled between the second output terminal of the rectifier circuit and the ground; and first and second diodes coupled in series between the second output terminal of the rectifier circuit and the base of the bipolar transistor.

2. The power supply of claim 1, wherein the controller comprises:

a first input terminal for receiving operating power from the secondary winding;

a second input terminal for sensing an average current from the rectifier circuit to determine a magnitude of the controlled output to the LED load;

a third input terminal for sensing the rectified DC input voltage for controlling the current pulses in the primary winding; and an output terminal for controlling the on and off of the power switch.

3. The power supply of claim 1, wherein the primary winding of the transformer is coupled to the LED load through a diode and a capacitor.

4. The power supply of claim 1, wherein the controller and the bleeder circuit are included in a single integrated circuit (IC).

5. The power supply of claim 1, wherein the controller is configured to generate a phase reference voltage having a magnitude that is in phase with the rectified DC input voltage; and the controller is configured to turn off current flow in the primary winding when a voltage signal associated with the current in the primary winding reaches the phase reference voltage.

6. The power supply of claim 5, wherein the phase reference voltage comprises a sinusoidal voltage signal characterized by:

a frequency matching the frequency of the AC input voltage; and a magnitude proportional to a desired output current.

7. The control circuit of claim 1, wherein the resistance of the second resistor, R, is selected such that $$R = \frac{V_{zener} - V_{TH}}{I_{hold}}$$

Wherein $V_{d1}$ is the forward voltage drop of the first diode, $V_{d2}$ is the forward voltage drop of the second diode, $V_{BE}$ is the forward base-emitter voltage of the bipolar transistor, and $I_{hold}$ is the holding current of the TRIAC dimmer.

8. The control circuit of claim 7, further comprising a third diode coupled between the first diode and the ground.

9. A control circuit for an LED (light-emitting diode) lighting system that includes a rectifier circuit for coupling to an AC input voltage through a TRIAC (Triode for Alternating Current) dimmer, the TRIAC dimmer being characterized by a holding current, the rectifier circuit being configured to provide a rectified DC input voltage to an inductor for supplying a constant current to an LED load, the control circuit comprises:

a controller for coupling to a power switch for controlling a current flow in the inductor, the controller being configured to control current pulses in the inductor such that an envelope waveform formed by peak points of the current pulses is in phase with the AC input voltage; and a bleeder circuit coupled to the rectifier circuit, wherein the bleeder circuit is configured to determine if that a current flow through the rectifier circuit is below the holding current of the TRIAC; and wherein the bleeder circuit is configured to provide a compensation current, upon determining that the current flow through the rectifier circuit is below the holding current of the TRIAC, to maintain a current flow through the rectifier circuit at a magnitude of at least the holding current of the TRIAC;

wherein the bleeder circuit comprises:

a first resistor and an MOS transistor connected in series between the first output terminal of the rectifier circuit and a ground, a gate of the MOS transistor being coupled to a bias voltage;

a first Zener diode coupled between the gate of the MOS transistor and a second output terminal of the rectifier circuit; and a second resistor coupled between the second output terminal of the rectifier circuit and the ground.

10. The control circuit of claim 9, wherein the resistance of the second resistor, R, is selected such that $$R = \frac{V_{d1} + V_{d2} - V_{BE}}{I_{hold}}$$

where $V_{zener}$ is the Zener voltage of the first Zener diode, $V_{GSTH}$ is the threshold voltage of MOS transistor, and $I_{hold}$ is the holding current of the TRIAC.

11. The control circuit of claim 9, wherein the controller and the bleeder circuit are included in a single integrated circuit (IC).

12. The control circuit of claim 9, wherein the controller is configured to improve the power factor of the LED lighting system and reduce power consumption in the bleeder circuit.

13. The control circuit of claim 9, wherein the controller comprises:

a first input terminal for receiving operating power from the secondary winding;

a second input terminal for sensing an average current from the rectifier circuit to determine a magnitude of the controlled output to the LED load;

a third input terminal for sensing the rectified DC input voltage for controlling the current pulses in the primary winding; and an output terminal for controlling the on and off of the power switch.

14. A method for reducing bleeder current consumption in a switched mode power supply (SMPS) for an LED (light-emitting diode) lighting system that includes a rectifier circuit for coupling to an AC input voltage through a TRIAC (Triode for Alternating Current) dimmer, the TRIAC dimmer being characterized by a holding current, the rectifier circuit having a first output terminal and a second output terminal, the rectifier circuit being configured to provide a rectified DC input voltage to an inductor for supplying power to an LED load, the method comprises:

providing a controller for coupling to a power switch for controlling a current flow in the inductor, the controller being configured to provide controlled output current to the LED load according to the rectified DC input voltage;

providing a bleeder circuit coupled to the rectifier circuit, wherein the bleeder circuit is configured to provide a compensation current when the current flow through the rectifier circuit falls below the holding current of the TRIAC; and configuring the controller to control current pulses in the inductor such that an envelope waveform formed by peak points of the current pulses is in phase with the AC input voltage, thereby reducing current consumption caused by the compensation current in the bleeder circuit;

wherein the bleeder circuit comprises:

a first resistor and a bipolar transistor coupled in series between the first output terminal of the rectifier circuit and a ground, a base of the bipolar transistor being configured for receiving a bias voltage;

a second resistor coupled between the second output terminal of the rectifier circuit and the ground; and first and second diodes connected in series between the second output terminal of the rectifier circuit and the base of the bipolar transistor;

wherein the resistance of the second resistor, R, is selected such that $$R = \frac{V_{d1} + V_{d2} - V_{BE}}{I_{hold}}$$

wherein:

$V_{d1}$ is the forward voltage drop of the first diode, $V_{d2}$ is the forward voltage drop of the second diode, $V_{BE}$ is the forward base-emitter voltage of the bipolar transistor, and $I_{hold}$ is the holding current of the TRIAC dimmer.

15. The method of claim 14, wherein the inductor is a primary winding in a transformer in a flyback configuration.

16. The method of claim 14, wherein the inductor is a primary winding in a transformer, and the inductor is coupled to the LED load through a diode and a capacitor.

17. The method of claim 14, wherein the controller comprises:

a first input terminal for receiving operating power from the secondary winding;

a second input terminal for sensing an average current from the rectifier circuit to determine a magnitude of the controlled output to the LED load;

a third input terminal for sensing the rectified DC input voltage for controlling the current pulses in the primary winding; and an output terminal for controlling the on and off of the power switch.

* * * * *